US010631635B2

(12) United States Patent
Breslow et al.

(10) Patent No.: US 10,631,635 B2
(45) Date of Patent: Apr. 28, 2020

(54) LOW VOLTAGE POWER SYSTEM FOR A MERCHANDISE DISPLAY

(71) Applicant: RTC Industries, Inc., Rolling Meadows, IL (US)

(72) Inventors: David S. Breslow, Chicago, IL (US); Scott May, Chicago, IL (US)

(73) Assignee: RTC Industries, Inc., Rolling Meadows, IL (US)

( * ) Notice: Subject to any disclaimer, the term of this patent is extended or adjusted under 35 U.S.C. 154(b) by 0 days.

(21) Appl. No.: 16/257,402

(22) Filed: Jan. 25, 2019

(65) Prior Publication Data

US 2019/0231068 A1 Aug. 1, 2019

Related U.S. Application Data

(60) Provisional application No. 62/622,590, filed on Jan. 26, 2018.

(51) Int. Cl.

| | |
|---|---|
| ***A47B 57/58*** | (2006.01) |
| ***A47F 11/10*** | (2006.01) |
| ***A47F 1/12*** | (2006.01) |
| ***A47F 5/00*** | (2006.01) |
| ***F21V 23/00*** | (2015.01) |
| ***H01R 25/14*** | (2006.01) |
| *F21W 131/405* | (2006.01) |
| *F21Y 103/10* | (2016.01) |

(52) U.S. Cl.

CPC ..... *A47B 57/58* (2013.01); *A47F 1/126* (2013.01); *A47F 5/0025* (2013.01); *A47F 11/10* (2013.01); *F21V 23/008* (2013.01); *H01R 25/147* (2013.01); *A47B 2220/0077* (2013.01); *A47F 5/0043* (2013.01); *F21W 2131/405* (2013.01); *F21Y 2103/10* (2016.08)

(58) Field of Classification Search

CPC ..... A47B 57/58; A47B 2220/0077; F21V 23/008; A47F 1/126; A47F 5/0025; A47F 11/10; A47F 5/0043; H01R 25/147; F21Y 2103/10; F21W 2131/405

See application file for complete search history.

(56) References Cited

U.S. PATENT DOCUMENTS 3,531,758 A * 9/1970 Blumkin ..... H01R 25/14 174/88 B 3,622,938 A 11/1971 Ito et al.

(Continued)

FOREIGN PATENT DOCUMENTS

CA 2178502 A1 6/1995
CA 2173799 A1 10/1997

(Continued)

OTHER PUBLICATIONS

Apr. 8, 2019—(WO) ISR and WO—App. No. PCT/US19/15159.

(Continued)

*Primary Examiner* — Ko H Chan

(74) *Attorney, Agent, or Firm* — Banner & Witcoff, Ltd.

(57) ABSTRACT

A low voltage power system with a rail member that fits on the front portion of a shelf of a merchandise display, where is the rail member has a pair of conductive members positioned within an upper channel of the rail member is disclosed. The rail member may have supply power to a variety of low voltage power devices.

17 Claims, 18 Drawing Sheets

(56) References Cited

U.S. PATENT DOCUMENTS 4,190,309 A 2/1980 Glass
4,414,617 A 11/1983 Galindo
4,778,397 A 10/1988 Contant et al.
4,825,540 A 5/1989 Kelly
4,861,273 A 8/1989 Wenman et al.
4,875,871 A 10/1989 Booty, Sr. et al.
4,919,625 A * 4/1990 Coutre ..... H01R 25/14 439/118
5,025,355 A 6/1991 Harwood
5,154,509 A 10/1992 Wulfman et al.
5,168,173 A 12/1992 Windsor
5,205,638 A 4/1993 Squitieri
5,319,250 A 6/1994 Windsor
5,366,100 A 11/1994 Maglione
5,545,958 A 8/1996 Kramer
5,551,577 A 9/1996 Hagopian
5,588,537 A 12/1996 Hagopian
5,673,985 A 10/1997 Mitchell
5,695,261 A 12/1997 Slesinger et al.
5,746,332 A 5/1998 Kleinschmidt
5,758,585 A 6/1998 Latchinian
5,785,411 A 7/1998 Komai et al.
5,794,794 A 8/1998 Hull
5,810,457 A 9/1998 Felsenthal et al.
5,811,892 A 9/1998 Battles et al.
5,829,864 A 11/1998 Scanlan
5,921,190 A 7/1999 Wood
6,021,908 A 2/2000 Mathews
6,033,097 A 3/2000 Harwood
6,059,582 A * 5/2000 Tsai ..... H01R 25/142 362/287
6,113,198 A 9/2000 Hommes
6,135,583 A 10/2000 Simon et al.
6,138,583 A 10/2000 Mahone et al.
6,204,632 B1 3/2001 Nierescher et al.
6,231,205 B1 5/2001 Slesinger et al.
6,302,282 B1 10/2001 Gay et al.
6,341,440 B1 * 1/2002 Lee ..... G02B 6/0025 40/541
6,364,273 B1 4/2002 Otema
6,406,108 B1 6/2002 Upton et al.
6,460,470 B1 10/2002 Scharer et al.
6,478,444 B2 11/2002 Schaerer et al.
6,527,406 B1 3/2003 Slesinger et al.
6,543,688 B1 4/2003 Massaro
6,550,673 B2 4/2003 Massaro
6,585,529 B2 7/2003 Zakerzewski
6,619,814 B1 9/2003 Hamada et al.
6,669,029 B1 12/2003 Beane
6,742,907 B2 6/2004 Funamoto et al.
6,749,116 B2 6/2004 Massaro
6,796,248 B1 9/2004 Dressendorfer et al.
6,895,705 B2 5/2005 Hillstrom et al.
6,902,308 B2 6/2005 Love
6,932,446 B2 8/2005 Hales
7,025,217 B2 4/2006 Crown et al.
7,040,494 B2 5/2006 Harper
7,121,675 B2 10/2006 Ter-Hovhannisian
7,137,727 B2 11/2006 Joseph et al.
7,172,332 B2 2/2007 Mobarak et al.
7,173,821 B2 2/2007 Coglitore
7,175,034 B2 2/2007 Nook et al.
7,201,487 B2 4/2007 Pinter
7,201,488 B2 4/2007 Sakamoto et al.
7,367,685 B2 5/2008 Moll
7,453,419 B2 11/2008 Yee et al.
7,513,675 B2 4/2009 Mier-Langner et al.
7,537,374 B2 5/2009 Schardt et al.
7,597,462 B2 10/2009 Misof
7,614,350 B2 11/2009 Tuttle et al.
7,665,860 B2 2/2010 Demarest et al.
7,726,057 B2 * 6/2010 Brinkman ..... G09F 3/204 248/220.21
7,743,933 B2 6/2010 Martin et al.
7,784,885 B2 8/2010 Steiger et al.
7,806,268 B2 10/2010 Angelocci
7,806,543 B2 10/2010 Swofford et al.
7,832,874 B2 11/2010 Ikeda et al.
7,832,888 B2 11/2010 Demarest et al.
7,840,286 B2 11/2010 Caldwell et al.
7,857,214 B2 12/2010 Saliaris
7,909,499 B2 3/2011 Snagel et al.
7,954,958 B2 6/2011 Ikeda et al.
7,997,430 B2 8/2011 Clark et al.
8,021,009 B2 9/2011 Knoll et al.
8,047,657 B2 11/2011 Ikeda et al.
8,123,052 B2 2/2012 Clark et al.
8,128,272 B2 3/2012 Fine et al.
8,135,482 B2 3/2012 Caldwell et al.
8,651,711 B2 2/2014 Rudisill et al.
8,968,011 B2 * 3/2015 Hoffmeister ..... H01R 25/142 439/110
9,060,624 B2 * 6/2015 Hardy ..... A47F 5/005
9,251,727 B2 * 2/2016 Browning ..... G09F 9/30
10,164,388 B2 * 12/2018 Kokenda ..... H02G 5/00
2002/0064979 A1 5/2002 Zakerzewski
2002/0073902 A1 6/2002 Jipp
2003/0056697 A1 3/2003 Crown et al.
2003/0084827 A1 5/2003 Nicholson et al.
2003/0179578 A1 9/2003 Albert et al.
2003/0223232 A1 12/2003 Belfer et al.
2004/0050812 A1 * 3/2004 Rojas ..... A47F 5/0068 211/134
2004/0222720 A1 11/2004 Ellis
2005/0173605 A1 8/2005 Villeneuve et al.
2006/0011794 A1 * 1/2006 Zadak ..... A47F 5/0884 248/220.31
2006/0048419 A1 * 3/2006 Yenglin ..... G02B 6/0095 40/547
2006/0075670 A1 * 4/2006 Brinkman ..... G09F 3/204 40/666
2007/0262685 A1 11/2007 Randolph
2007/0294926 A1 12/2007 Andersen et al.
2008/0121146 A1 5/2008 Burns et al.
2008/0155915 A1 7/2008 Howe et al.
2008/0230497 A1 9/2008 Strickland et al.
2008/0258589 A1 10/2008 Nielsen
2009/0122575 A1 5/2009 Omura et al.
2009/0244925 A1 10/2009 Snagel et al.
2009/0273730 A1 11/2009 Mills
2009/0279298 A1 11/2009 Mier-Langner et al.
2009/0308286 A1 12/2009 Bourbeau
2010/0012600 A1 1/2010 Clontz et al.
2010/0135038 A1 6/2010 Handschy et al.
2010/0149835 A1 6/2010 Cho et al.
2010/0214802 A1 8/2010 Masuda et al.
2010/0290215 A1 11/2010 Metcalf et al.
2010/0302802 A1 12/2010 Bita et al.
2010/0321929 A1 12/2010 Ramirez et al.
2011/0054673 A1 3/2011 Segal et al.
2011/0068071 A1 3/2011 Suman et al.
2011/0128469 A1 6/2011 Wang
2011/0128471 A1 6/2011 Suckling et al.
2011/0132854 A1 6/2011 Berdahl et al.
2011/0136353 A1 6/2011 Spitaels et al.
2011/0168651 A1 7/2011 Stenftenagel et al.
2011/0199555 A1 8/2011 Coe-Sullivan et al.
2011/0204009 A1 8/2011 Karan
2011/0216387 A1 9/2011 Whitehead et al.
2011/0227487 A1 9/2011 Nichol et al.
2011/0273867 A1 11/2011 Horst et al.
2011/0292679 A1 12/2011 Kim
2011/0309041 A1 12/2011 Amadio et al.
2012/0001254 A1 1/2012 Kronholz et al.
2012/0063125 A1 3/2012 Quaal et al.
2012/0085713 A1 4/2012 Bowser et al.
2013/0044501 A1 2/2013 Rudisill et al.
2013/0207478 A1 8/2013 Metcalf et al.
2013/0033766 A1 12/2013 Ernest et al.

(56) References Cited

U.S. PATENT DOCUMENTS

| | | | |
|---|---|---|---|
| 2015/0173528 | A1 | 6/2015 | Hester-Redmond |
| 2018/0106468 | A1 | 4/2018 | Nicieja |

FOREIGN PATENT DOCUMENTS

| | | | |
|---|---|---|---|
| CA | 2250945 | A1 | 10/1997 |
| CA | 2393427 | A1 | 6/2001 |
| CA | 2467585 | A1 | 5/2003 |
| CA | 2471190 | A1 | 12/2004 |
| CA | 2443755 | A1 | 4/2005 |
| CA | 2485670 | A1 | 4/2005 |
| CA | 2554834 | A1 | 8/2005 |
| CA | 2525992 | A1 | 5/2006 |
| CA | 2501809 | A1 | 9/2006 |
| CA | 2558608 | A1 | 2/2008 |
| CA | 2568612 | A1 | 4/2008 |
| CA | 2671794 | A1 | 6/2008 |
| CA | 2653264 | A1 | 8/2009 |
| CA | 2706720 | A1 | 9/2009 |
| CA | 2681996 | A1 | 4/2010 |
| CA | 2752749 | A1 | 11/2011 |
| DE | 202010003919 | U1 | 7/2010 |
| DE | 20 2012 008 355 | U1 | 10/2012 |
| EP | 1286612 | A1 | 3/2003 |
| EP | 1830680 | A1 | 9/2007 |
| EP | 1839539 | A2 | 10/2007 |
| FR | 2850550 | A1 | 8/2004 |
| FR | 2852502 | A1 | 9/2004 |
| FR | 2859889 | A1 | 3/2005 |
| FR | 2860133 | A1 | 4/2005 |
| FR | 2869779 | A1 | 11/2005 |
| FR | 2881331 | A1 | 8/2006 |
| FR | 2891716 | A1 | 4/2007 |
| FR | 2923578 | A1 | 5/2009 |
| FR | 2940031 | A1 | 6/2010 |
| FR | 2946852 | A1 | 12/2010 |
| FR | 2950412 | A1 | 3/2011 |
| FR | 2955193 | A1 | 7/2011 |
| FR | 2960395 | A1 | 12/2011 |
| GB | 2297896 | A | 8/1996 |
| GB | 2325148 | A | 11/1998 |
| KR | 1994-0002346 | | 4/1994 |
| KR | 20070106298 | A | 11/2007 |
| WO | 1993018499 | A1 | 9/1993 |
| WO | 1996003902 | A1 | 2/1996 |
| WO | 1997005809 | A1 | 2/1997 |
| WO | 9738610 | A1 | 10/1997 |
| WO | 9851963 | A2 | 11/1998 |
| WO | 2000024297 | A1 | 5/2000 |
| WO | 2000075561 | A1 | 12/2000 |
| WO | 2001000065 | A1 | 1/2001 |
| WO | 2001043598 | A1 | 6/2001 |
| WO | 2001045537 | A1 | 6/2001 |
| WO | 2001093728 | A1 | 12/2001 |
| WO | 03070060 | A1 | 8/2003 |
| WO | 2003063655 | A1 | 8/2003 |
| WO | 2004102354 | A2 | 11/2004 |
| WO | 2005074635 | A2 | 8/2005 |
| WO | 2006067396 | A1 | 6/2006 |
| WO | 2006086998 | A1 | 8/2006 |
| WO | 2007016515 | A1 | 2/2007 |
| WO | 2008073829 | A2 | 6/2008 |
| WO | 2008133712 | A1 | 11/2008 |
| WO | 2008/152973 | A1 | 12/2008 |
| WO | 2010005093 | A1 | 1/2010 |
| WO | 2011046593 | A2 | 4/2011 |
| WO | 2011115685 | A1 | 9/2011 |
| WO | 2013/192491 | A1 | 12/2013 |

OTHER PUBLICATIONS

Aug. 13, 2014—(WO) ISR and Written Opinion—App. No. PCT/US2014/043831.
Dec. 8, 2014—U.S. Non-Final Office Action—U.S. Appl. No. 13/924,948.
Oct. 23, 2014—U.S. Non-Final Office Action—U.S. Appl. No. 13/918,281.
Apr. 9, 2015—U.S. Non Final Office Action—U.S. Appl. No. 14/254,873.
Jul. 13, 2016—(AU) First Examination Report—App 2014302709.
Jan. 26, 2017—U.S. Non-Final Office Action—U.S. Appl. No. 15/164,174.
Oct. 16, 2015—U.S. Final Office Action—U.S. Appl. No. 14/254,873.
Dec. 29, 2015—(WO) IPRP and Written Opinion—App. No. PCT/US2014/043831.
Oct. 22, 2015—(WO) ISR and Written Opinion—App. No. PCT/US2015/026208.
Feb. 15, 2017—(KR) Office Action—App. No. 10-2016-7001727.
Mar. 3, 2017—(CN) First Office Action—App. No. 201480042694.3.
Feb. 22, 2017—(CN) Search Report—App. No. 2014800426943.
Aug. 18, 2017—(EP) Office Action—App. No. 15722606.9.
Apr. 21, 2015—U.S. Final Office Action—U.S. Appl. No. 13/918,281.
Dec. 15, 2017—(KR) Office Action—App. No. 10-2016-7031699.
Feb. 9, 2018—(EP) Office Action—App. No. 15722606.9.
Mar. 27, 2018—U.S. Non-Final Office Action—U.S. Appl. No. 15/789,677.
Aug. 18, 2018—(AU) Examination Report—App. No. 2015247530.
Nov. 1, 2018—(CN) First Office Action—App. No. 201580030019.3.
Nov. 23, 2018—U.S. Final Office Action—U.S. Appl. No. 15/789,677.
Feb. 8, 2019—(EP) Office Action—App. No. 14740082.4.
May 17, 2019—(CN) Second Office Action—App. No. 201580030019.3.

* cited by examiner

LOW VOLTAGE POWER SYSTEM FOR A MERCHANDISE DISPLAY

CROSS-REFERENCE TO RELATED APPLICATIONS

This application claims priority to U.S. Provisional Application No. 62/622,590 filed on Jan. 26, 2018. The above referenced application is incorporated by reference in its entirety.

FIELD OF INVENTION

This disclosure relates generally to power systems, in particular, in one aspect of the invention, a low voltage power system to transmit power to at least one low voltage power device on a shelf of a merchandise display.

BACKGROUND

In many exemplary power/signal systems, providing power to many devices along a shelf of a merchandise display may, in certain instances, be desired. Additionally, providing power to many devices while creating a dynamic or flexible system that allows for device relocation, addition of devices, and removal of devices for the power/signal systems may, in certain instances, be desired.

BRIEF SUMMARY

This disclosure may relate to a low voltage power system for a merchandise display comprising a rail member that includes a shelf-engaging member extending between a first end of the rail member and a second end of the rail member opposite the first end, where the shelf-engaging member is configured to contact an upper surface of a first shelf of the merchandise display. The shelf-engaging member may comprise a front end configured to be adjacent a front side of the first shelf of the merchandise display. A power connector portion may be attached to the front end of the shelf-engaging member and extend from the first end to the second end of the rail member, where the power connector portion includes a top surface, a front surface, a rear surface opposite the front surface, and a recess opposite the top surface. The recess may include a pair of upper channels where the pair of upper channels comprises a first upper channel located on a first inner recess surface opposite the front surface and a second upper channel located on a second inner recess surface opposite the rear surface. A first conductive member may be secured in the first upper channel and a second conductive member may be secured in the second upper channel, where the first and second conductive members transmit electrical power to at least one low voltage device.

Other aspects of this disclosure may relate to a low voltage power system where the first conductive member and the second conductive member are continuous along approximately an entire length of the rail member, where the entire length is defined as a distance from the first end of the rail member to the second end of the rail member. The first conductive member and the second conductive member may both have rectangular cross-sectional shapes. In addition, an end cap may be secured within the recess in the first end or the second end of the rail member. The rail member may include a label display holder, where the label display holder extends from a lower surface of the shelf-engaging member and includes a central channel configured to secure a product label. A receiving member may extend rearward from a lower edge of the label display holder, where the receiving member is configured to receive an LED lighting assembly to illuminate a second shelf below the first shelf.

Still other aspects of this disclosure may relate to a low voltage power system having a voltage of less than 24 volts. Additionally, the low voltage power system may provide power to a plurality of low voltage power devices simultaneously, where each low voltage device may be powered at any location along a length of the rail member. The shelf-engaging member of the rail member may include a pair of elongated slots extending through the shelf-engaging member, where each slot of the pair of elongated slots receives an engaging member from a product management system, where the product management system includes a pusher system. The shelf-engaging member may be positioned underneath a front rail of the product management system. The low voltage device may be an illuminated tab, where the illuminated tab includes a label holder, an array of LEDs secured in a tab clip, and a first conductive spring contact engaged with the first conductive member and a second conductive spring contact engaged with the second conductive member.

Additional aspects of this disclosure may relate to a low voltage power system where the at least one low voltage device is an illuminated product highlighter, where the illuminated product highlighter includes a platform for supporting product, a first electrical contact engaged with the first conductive member, a second electrical contact engaged with the second conductive member, and a plurality of LEDs that illuminate underneath the product. The at least one low voltage device may include a first spring contact engaging the first conductor member and a second spring contact engaging the second conductor member, wherein the first spring contact and the second spring contact provide both an electrical connection to power the low voltage device and a mechanical connection to secure the low voltage device to the power connector portion. The first power connector and the second power connector may both comprise a plurality of pieces that are intermittently located within the power connector portion.

BRIEF DESCRIPTION OF THE DRAWINGS

A more complete understanding of the present invention and certain advantages thereof may be acquired by referring to the following detailed description in consideration with the accompanying drawings, in which.

DETAILED DESCRIPTION

In the following description of various example structures in accordance with the invention, reference is made to the accompanying drawings, which form a part hereof, and in which are shown by way of illustration of various structures in accordance with the invention. Additionally, it is to be understood that other specific arrangements of parts and structures may be utilized and structural and functional modifications may be made without departing from the scope of the present invention. Also, while the terms "top" and "bottom" and the like may be used in this specification to describe various example features and elements of the invention, these terms are used herein as a matter of convenience, e.g., based on the example orientations shown in the Figures and/or the orientations in typical use. Nothing in this specification should be construed as requiring a specific three dimensional or spatial orientation of structures in order to fall within the scope of this invention. The reader is advised that the attached drawings are not necessarily drawn to scale.

In one exemplary aspect of the present invention, a low voltage power system may comprise a rail member that attaches to a shelf of a merchandise display, where the low voltage power system includes a configuration of conductive members arranged in a manner as to provide electrical power and/or signal distribution to a low voltage power device. The rail member may attach to the forward portion, the rear portion, and/or the side edge of a shelf of a merchandise display. The rail member may comprise a shelf-engaging member, a power connector portion, where the power connector portion may attach to (or extend from) a front end of the shelf-engaging member and comprise a recess. The recess of the power connector portion may include a pair of upper channels that may secure the conductive members to the rail member. The low voltage power device may connect to the conductive members anywhere along the length of the rail member. Generally, low voltage power systems and low voltage power devices may have a voltage of approximately 24 volts or less.

Figure 1:
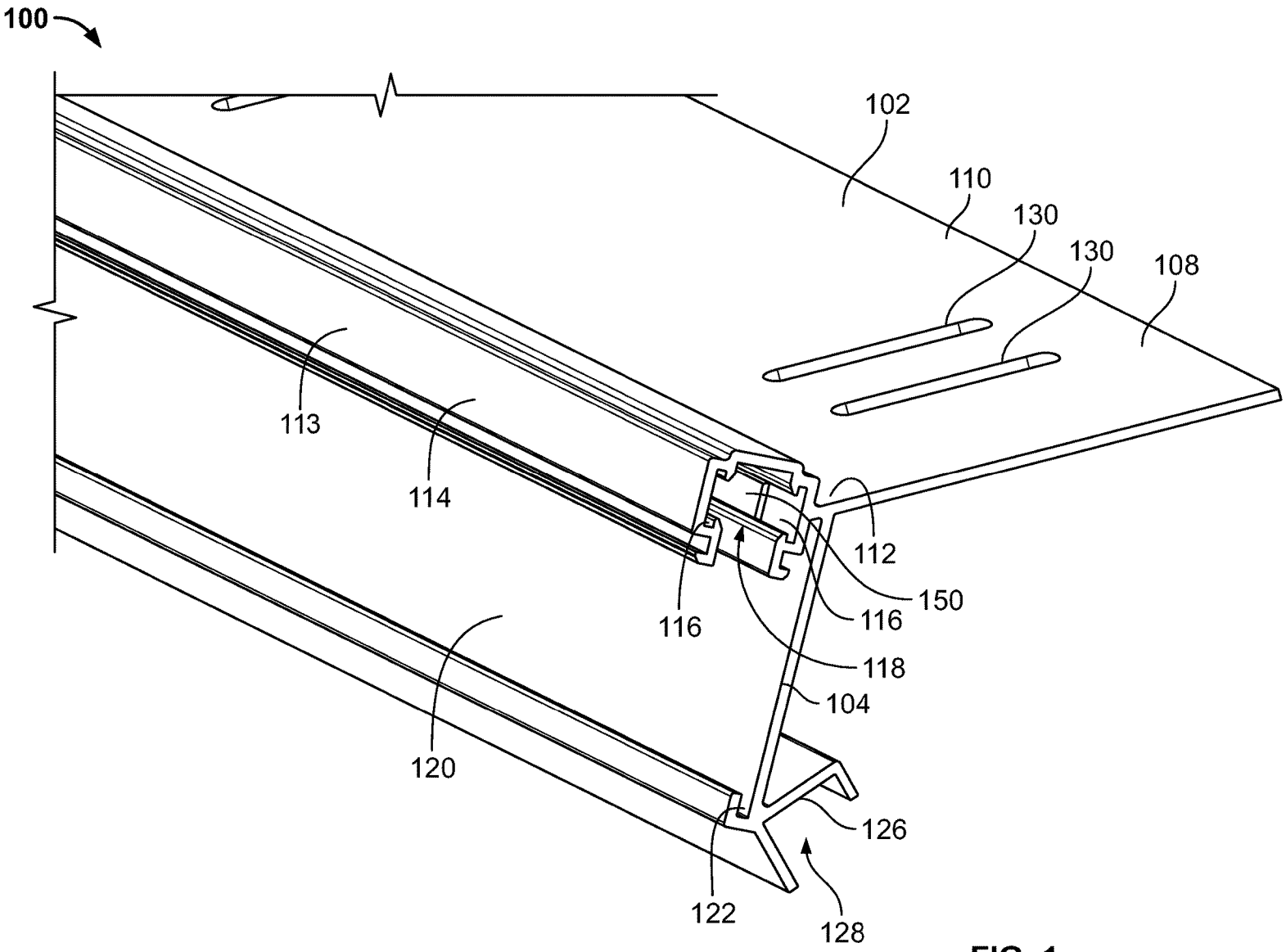
FIG. 1 depicts a partial isometric view of an exemplary low voltage power system as disclosed herein.

FIG. 1 illustrates a partial view of an exemplary low voltage power system 100 comprising a rail member 102 and a pair of conductive members 150. The rail member 102 may have a first end 104 and a second end 106 opposite the first end 104. The rail member 102 may further comprise a shelf-engaging member 108 to provide a secure attachment to a shelf 12 of a merchandise display 10, shown in FIGS. 2-4 extending between the first end 104 and the second end 106. The shelf-engaging member 108 may comprise a flat surface that contacts the upper surface of the shelf 12, which may be attached to the shelf 12 using an adhesive, magnets, or other similar means. Alternatively or optionally, the shelf-engaging member 108 may be secured to the shelf 12 by a product management system 14 as described in more detail below. The shelf-engaging member 108 may also have a rear end 110 and a front end 112. A power connector portion 114 may connect to and extend forward from the front end 112 of the shelf-engaging member 108 and extend the entire length of the rail member 102 from the first end 104 to the second end 106. The power connector portion 114 may include a front surface 113, a rear surface 115 opposite the front surface, and a top surface 119. The power connector portion 114 may connect to the shelf-engaging member 108 along the rear surface 115 of the power connector portion 114. The front surface 113, and the rear surface 115 may have the same cross-sectional length and in some embodiments, the top surface 119 may have the same cross-sectional length as either the front surface 113 or the rear surface 115.

A pair of conductive members 150 may be secured to the rail member 102 along a pair of upper channels 116 positioned within a recess 118 of the power connector portion 114. The pair of upper channels 116 may include a first upper channel 116A on a first inner recess surface opposite the front surface 113 and a second upper channel 116B on a second inner recess surface opposite the rear surface 115. The conductive members 150 may transmit the electrical power necessary to a plurality of low voltage devices that engage the conductive members 150. Each of the conductive members 150 may be inserted into each upper channel 116 from either end 104, 106 of the rail member 102. Each of the conductive members, or bus bars, 150 may be a continuous member such that it extends the entire length of the upper channel 116 or almost the entire length of the rail member 102. For example, as shown in FIG. 1, the length of the conductive members 150 may be the length of the rail member 102 minus an offset distance from the either end 104, 106 to allow room for the end cap 160, shown in FIGS. 4 and 5, which may be secured in the recess 118 at each end 104, 106. In other embodiments, the conductive members 150 may have a length of at least 90 percent of the length of the rail member 102, or have a length of at least 60 percent of the length of the rail member 102.

Figure 5:
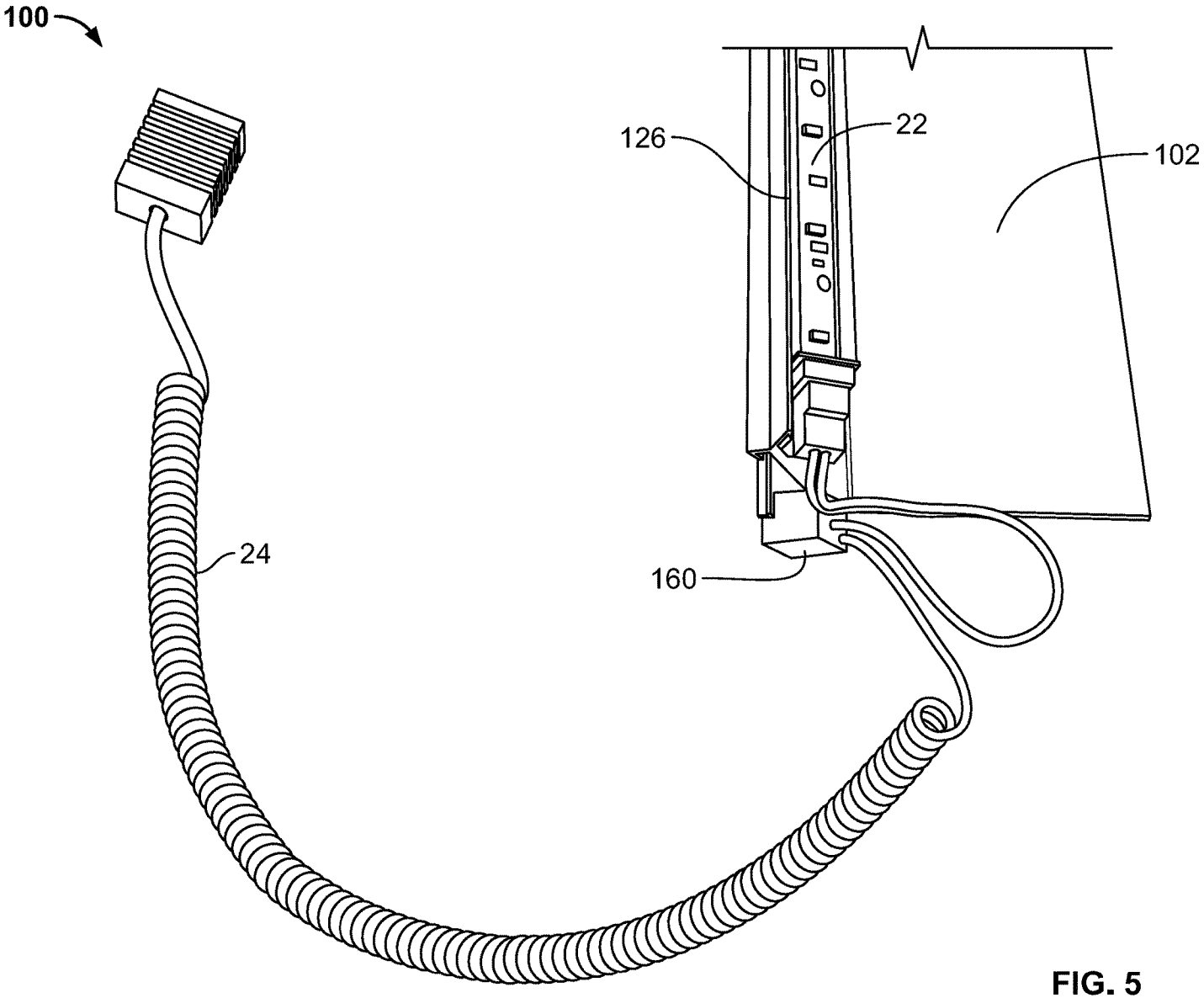
FIG. 5 depicts a bottom perspective view of the low voltage power system of FIG. 1 with a power cable attached.

In addition, a label display holder 120 may attach near the front end 112 of the shelf-engaging member 108, where the label display holder 120 may extend below the shelf-engaging member 108. The rear surface of the label display holder 120 may contact the front edge of the shelf 12 of the merchandise display and help to locate the rail member 102 on the shelf 12. The label display holder 120 may have a central channel 122 to secure product labels, price tags, or other similar materials to help describe the products on the merchandise display 10. In addition, the label display holder 120 may have a receiving member 126 extending rearward from a lower edge 124 of the label display holder 120. The receiving member 126 may also have a lower channel 128 that extends the length of the rail member 102. The receiving member 126 may secure a lighting assembly 22, such as an LED lighting assembly, to illuminate a second shelf below the shelf 12 having the low voltage power system 100 as shown in FIG. 5. Alternatively or optionally, a lighting assembly 22 may be secured to an upper region of the rail member 102 to illuminate the shelf 12 above the low voltage power system 100. Further, the receiving member 126 may be oriented such that any light coming from a lighting assembly 22 may be directed toward the front of a shelf below the shelf 12 having the low voltage power system 100. As shown in FIG. 5, the receiving member 126 may have an opening 131 of the lower channel 128 that is oriented downward opposite a top surface of the shelf-engaging member 108 and rearward away from the front surface 113 of the power connector portion 114.

Additionally, the low voltage power system 100 may be powered by a power cord 24 connected to a power source. The power cord 24 may be positioned under the shelf 12 or in another area of the merchandise display 10 and provide power to the conductive members 150. The power cord 24 may enter and exit the rail member 102 through one of the ends 104, 106, through the end cap 160, or from the recess 118. The power cord 24 may also provide power to the lighting assembly 22. Alternatively, the low voltage power system 100 may powered by a battery or other local power source. As another option, the power may be supplied to the low voltage power system 100 by a low voltage power supply as disclosed in U.S. patent application Ser. No. 14/254,873 filed on Jun. 7, 2016, now U.S. Pat. No. 9,360,196, which is incorporated by reference in its entirety.

Figure 2:
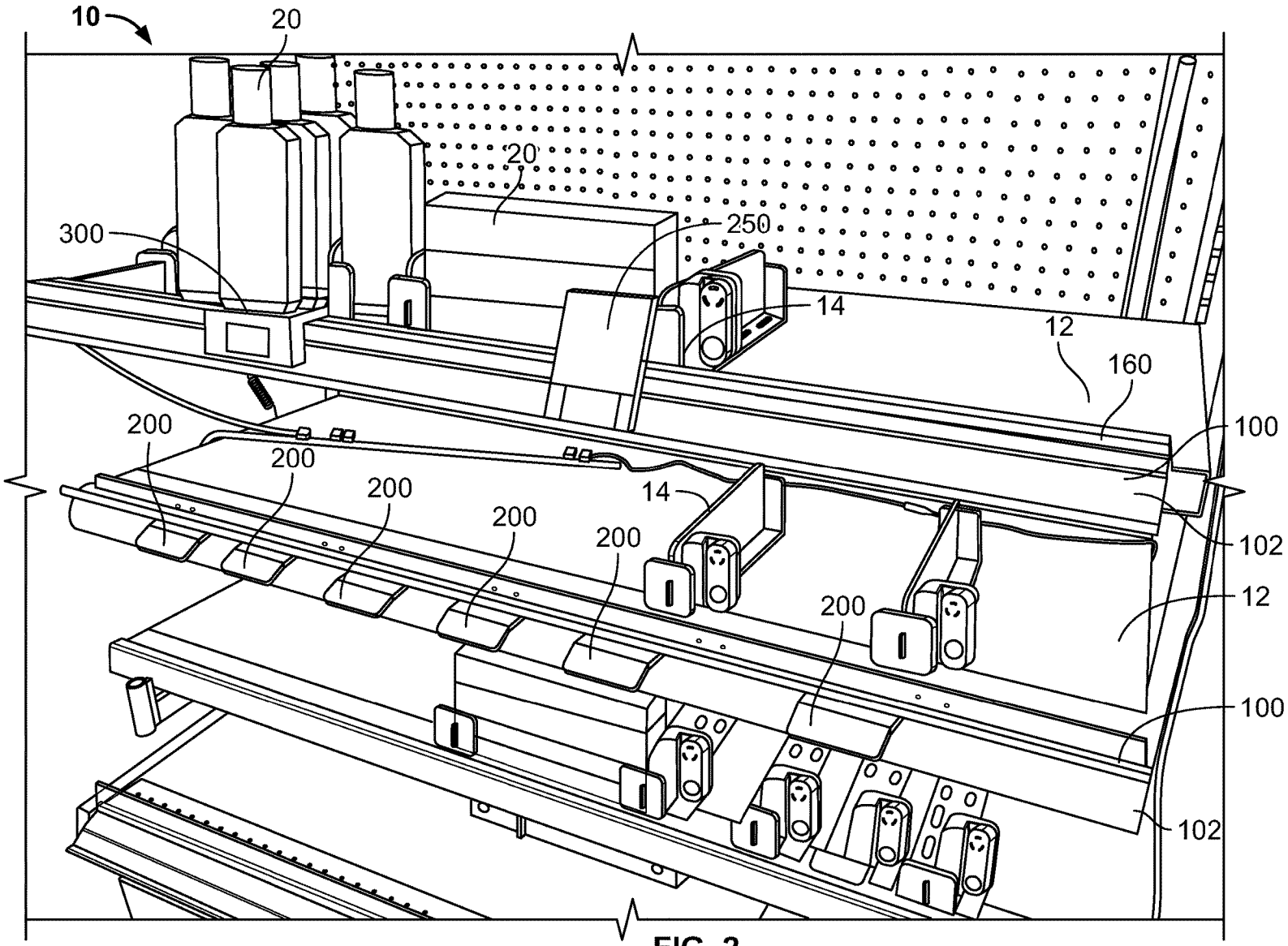
FIG. 2 depicts a partial front perspective view of a merchandise display with the low voltage power system of FIG. 1 as disclosed herein.
Figure 3:
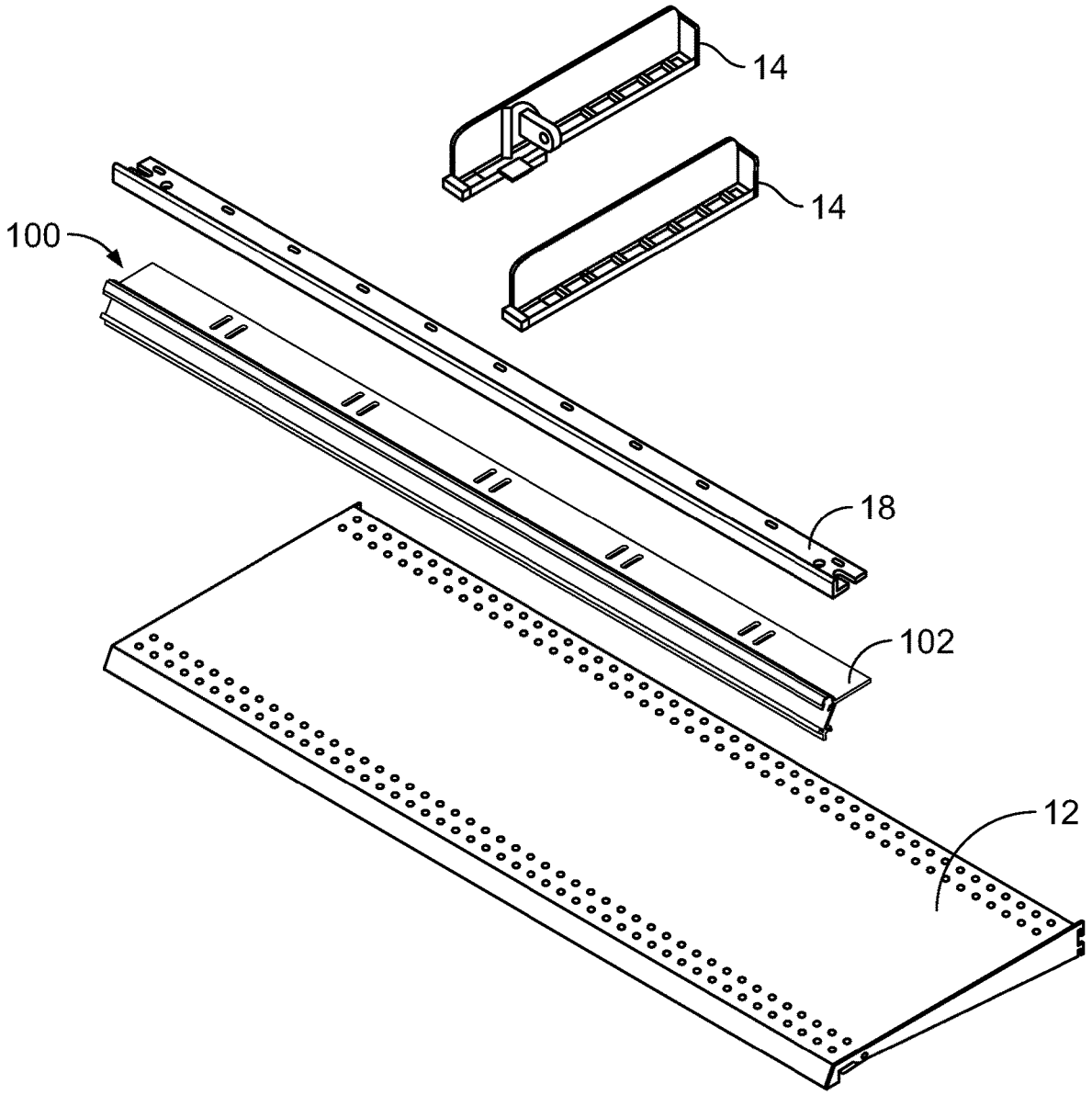
FIG. 3 depicts an exploded isometric view of a merchandise display with the low voltage power system of FIG. 1 as disclosed herein.
Figure 4:
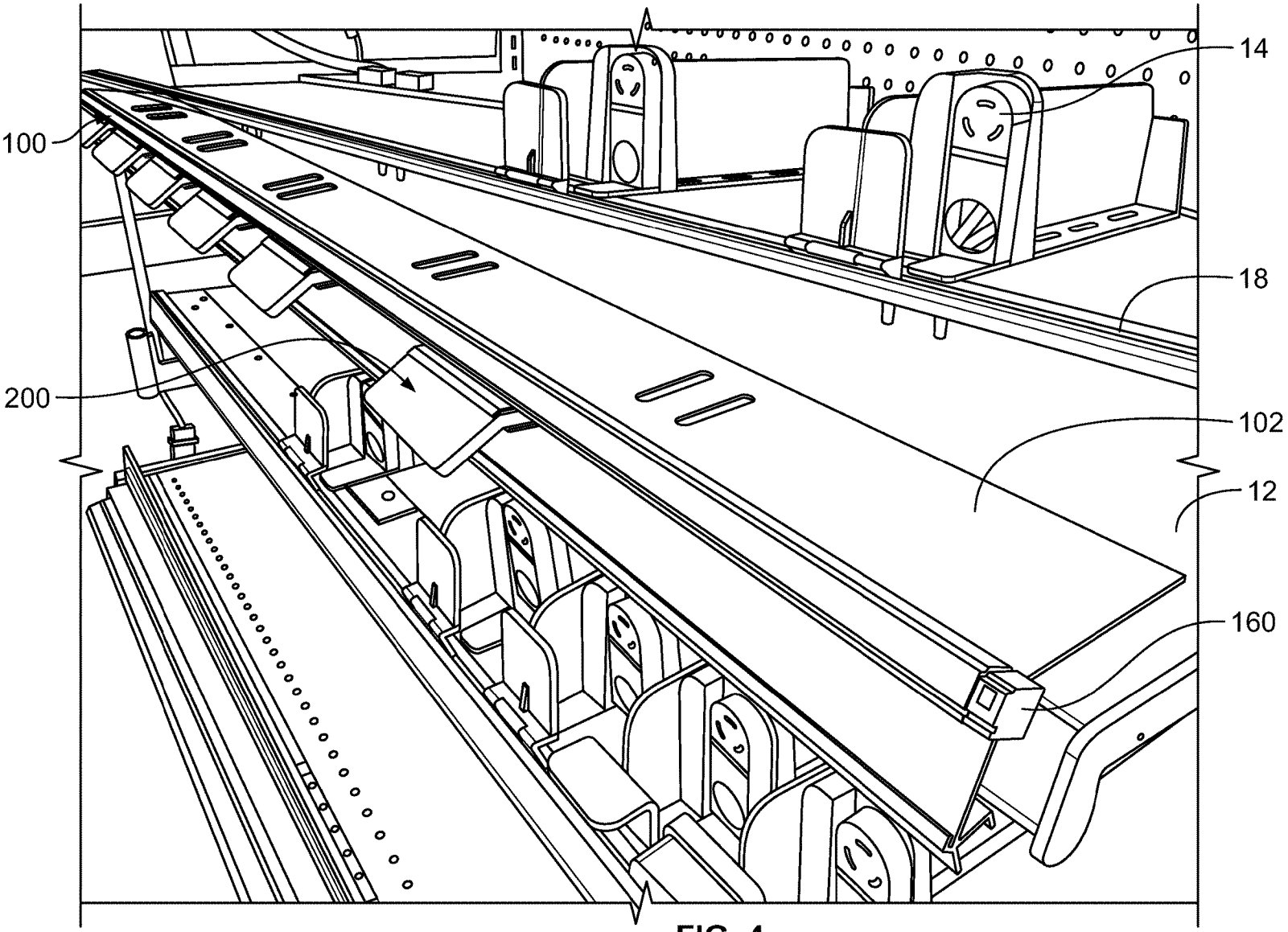
FIG. 4 depicts an isometric view of a partially disassembled merchandise display with the low voltage power system of FIG. 1 as disclosed herein.

FIG. 2 illustrates embodiments of the low voltage power system 100 installed on an exemplary merchandise display 10, while FIGS. 3 and 4 illustrate exploded views of the low voltage power system 100 assembled to a shelf 12 of a merchandise display 10. As shown in FIG. 2, each low voltage power system 100 may provide power to a plurality of low voltage devices 200, 250, 300 via electrical contacts on the low voltage devices engaging the conductive members 150. The low voltage devices 200, 250, 300 may attach at any location along the rail member 102, or alternatively adjacent to the rail member 102. Because the conductive members 150 extend along the length of the rail member 102, the low voltage power devices may be powered by the system 100 at any location along the length of the rail member 102. The low voltage power devices 200, 250, 300 powered by the system 100 may include illuminated tabs and signs, illuminated product highlighters, electronic shelf labels, motor driven display elements, such as spinning devices, LED screens, informational tablets, or similar devices. Still other devices that may be powered may include devices that are currently battery powered, like coupon dispensers. While not limited to these devices shown in the figures, devices 200, 250, 300 will be described in more detail below.

Figure 6:
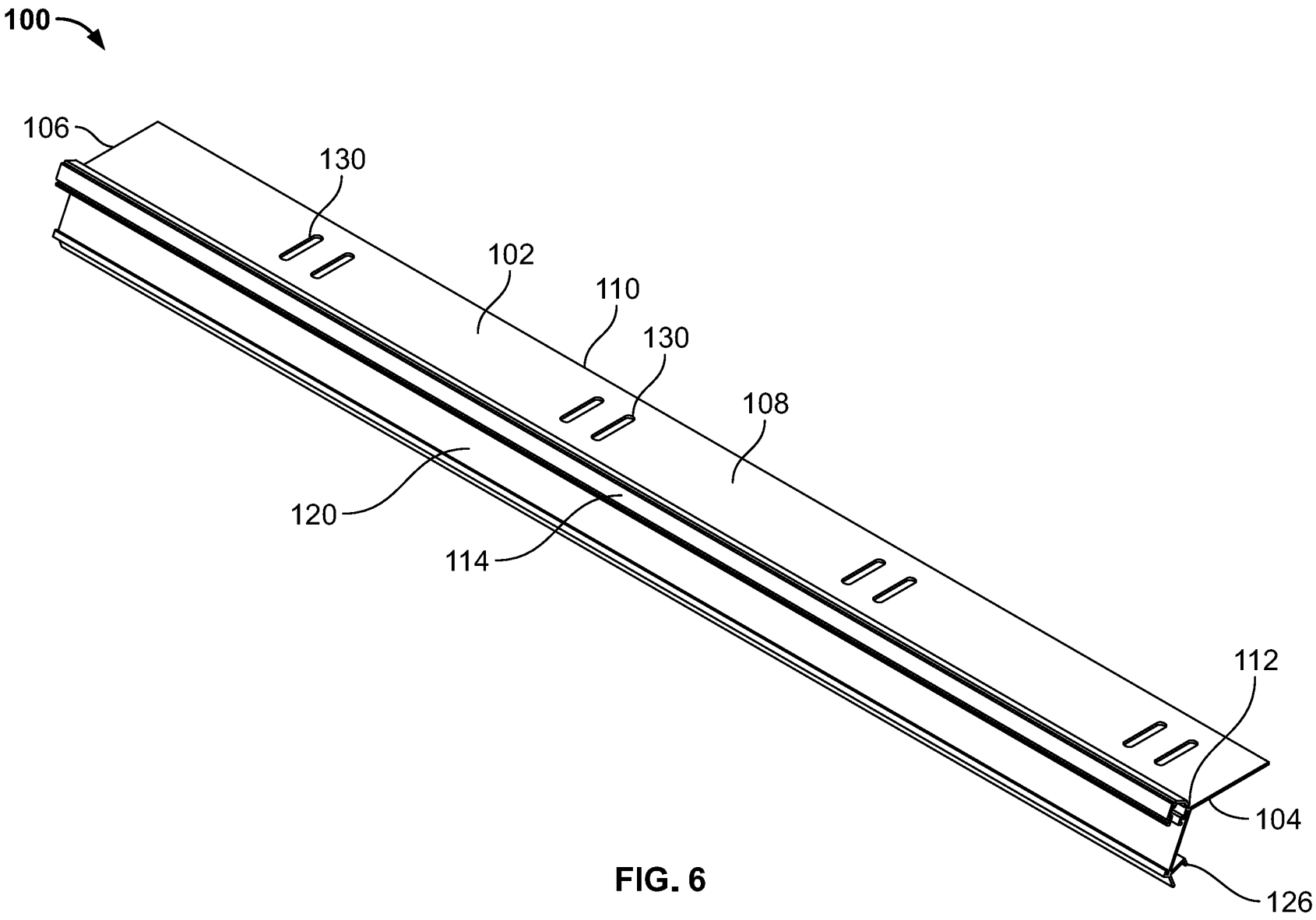
FIG. 6 depicts an isometric view of the exemplary low voltage power system of FIG. 1 as disclosed herein.
Figure 7:
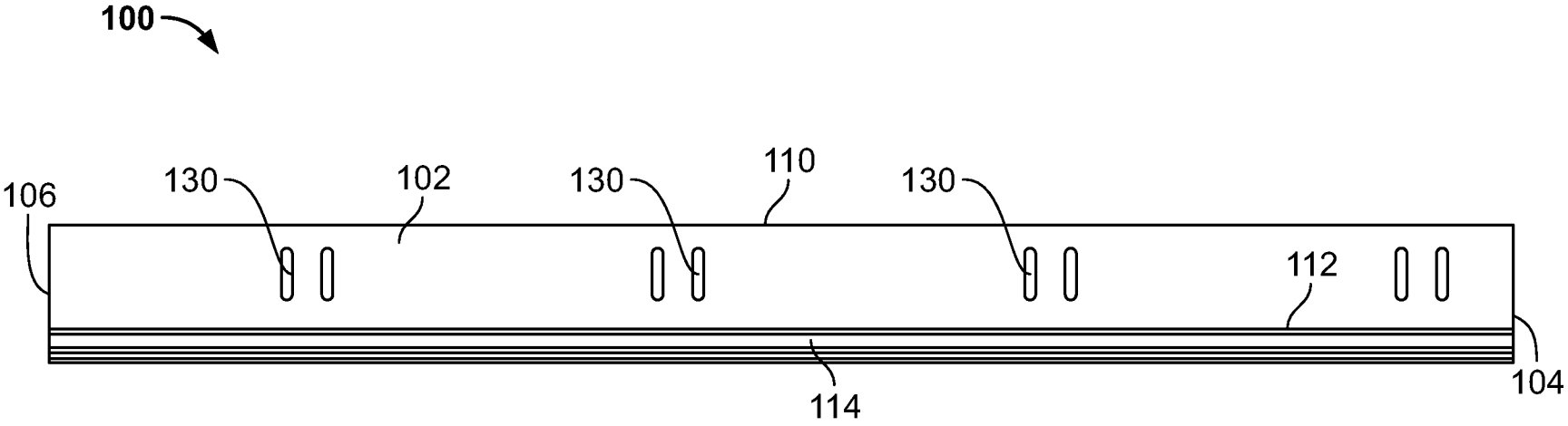
FIG. 7 depicts a top view of the exemplary low voltage power system of FIG. 1 as disclosed herein.

The low voltage power system 100 may work in conjunction with a product management system 14 that may comprise a plurality of dividers 16 to separate the products 20 on the shelf 12 and/or a pusher system 15 to keep products near the front of the shelf 12 as known to one skilled in the art, as shown in FIGS. 2, 3, and 4. An exemplary product management system 14 such as one that disclosed in U.S. patent application Ser. No. 11/684,253 filed on Mar. 9, 2007, now U.S. Pat. No. 8,627,965 and U.S. patent application Ser. No. 13/542,419 filed on Jul. 5, 2012, now U.S. Pat. No. 8,739,984, which are incorporated by reference in their entirety. The shelf-engaging member 108 may include a plurality of elongated slots 130 that extend through the shelf-engaging member 108. The elongated slots 130 may be arranged in pairs, and as shown in the exemplary embodiment of FIG. 6, the shelf-engaging member 108 may have multiple pairs of elongated slots 130. The slots 130 may align with a hole pattern located along the shelf 12 of the merchandise display 10. By having the slots 130 align with this hole pattern, the engaging members of a front rail portion 18 of the product management system 14 may extend through the slot 130 and into the shelf 12 of the merchandise display 10 allowing the low voltage power system 100 and the product management system 14 to work together to create an effective merchandise display. When the product management system 14 and the low voltage power system 100 are used together, the shelf-engaging member 108 may be positioned underneath a front rail portion 18 of a product management system 14. The low voltage power system 100 and the rail member 102 may also extend forward of the product management system 14 to avoid any interference with the product management system 14.

As shown in FIGS. 6-9, the low voltage power system 100 comprises a power connector portion 114 having a recess 118 with an opening on the lower portion of the power connector portion 114 opposite the top surface 119. A pair of upper channels 116 extend the length of the power connector 114. The upper channels 116 may have a corresponding shape to the conductive members 150. For example, as shown in the figures, each upper channel 116 and each conductive member 150 may have a rectangular cross-sectional shape. Alternatively, the upper channels 116 and conductive members 150 may have any cross-sectional shape such as round, square, oval or other geometric shape. In addition, each upper channel 116 may have tabs 117 at both the top and bottom of each upper channel 116 to retain the conductive members 150. The upper channels 116 may be substantially parallel to each other such that the conductive members 150 are configured substantially parallel to each other. Alternatively, the upper channels 116 and the conductive members 150 may be oriented substantially perpendicular to each other or at angle to each other.

In addition, the power connector portion 114 may have an exterior rear surface 115 adjacent the shelf-engaging member 108 that forms an acute angle with the shelf-engaging member 108. For example, the acute angle between the rear surface 115 and the shelf-engaging member 108 may be approximately 65 degrees, or within a range of 45 to 80 degrees. In addition, the label display holder 120 may have a front surface 121 that is substantially parallel to the rear surface 115 of the power connector portion 114. As discussed above, a receiving member 126 may extend from the lower edge 123 of the label display holder 120. The receiving member 126 may a pair of substantially parallel walls 127 extending downward on either side of the lower channel 128. The parallel walls 127 may have different lengths or may have the same length. Each of the walls 127 may have a tab 129 extending substantially perpendicular to each of the walls 127 to help secure the lighting assembly 22, or other device that may be installed within the lower channel 128.

Figure 8:
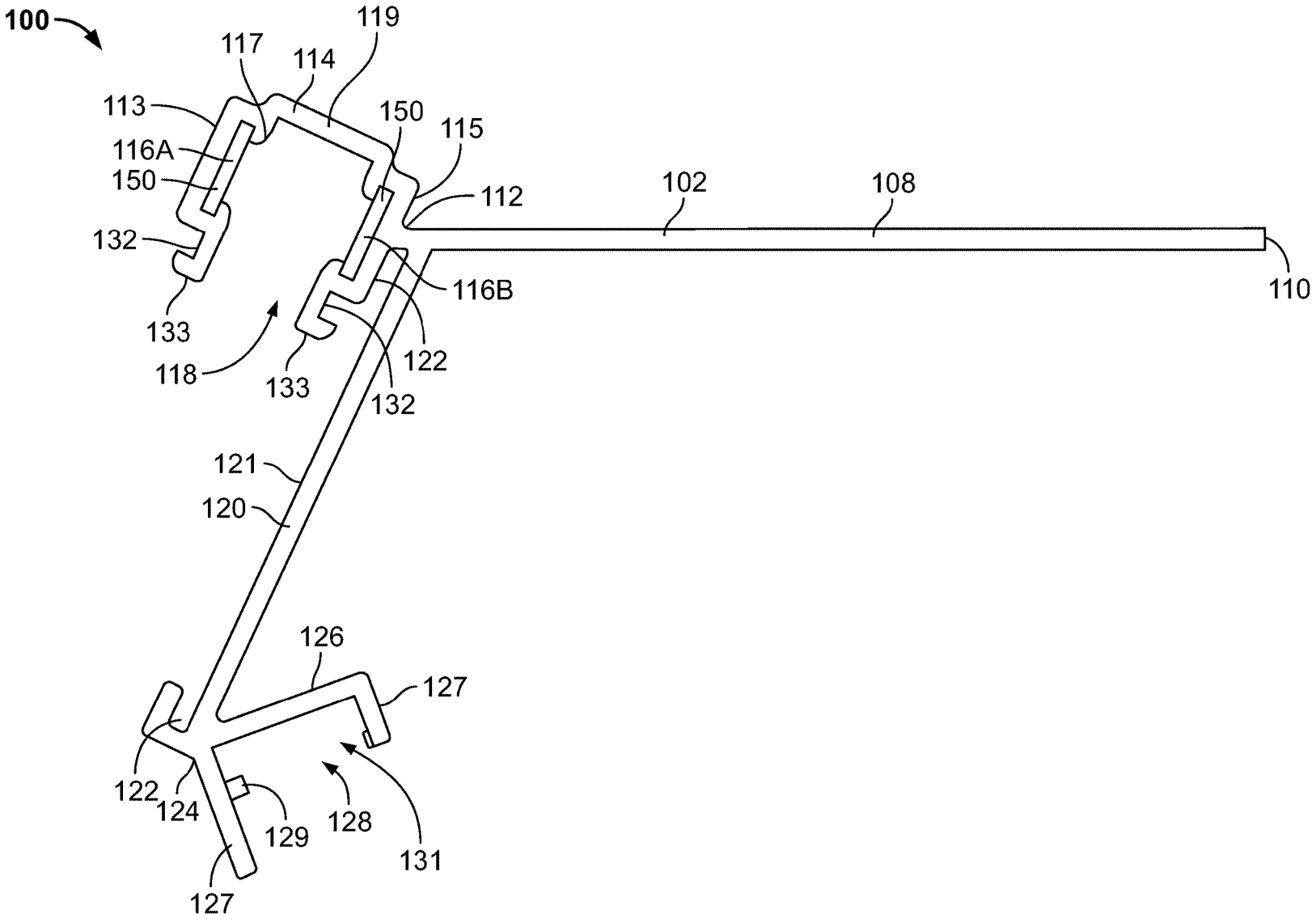
FIG. 8 depicts a side view of the exemplary low voltage power system of FIG. 1 as disclosed herein.
Figure 9:
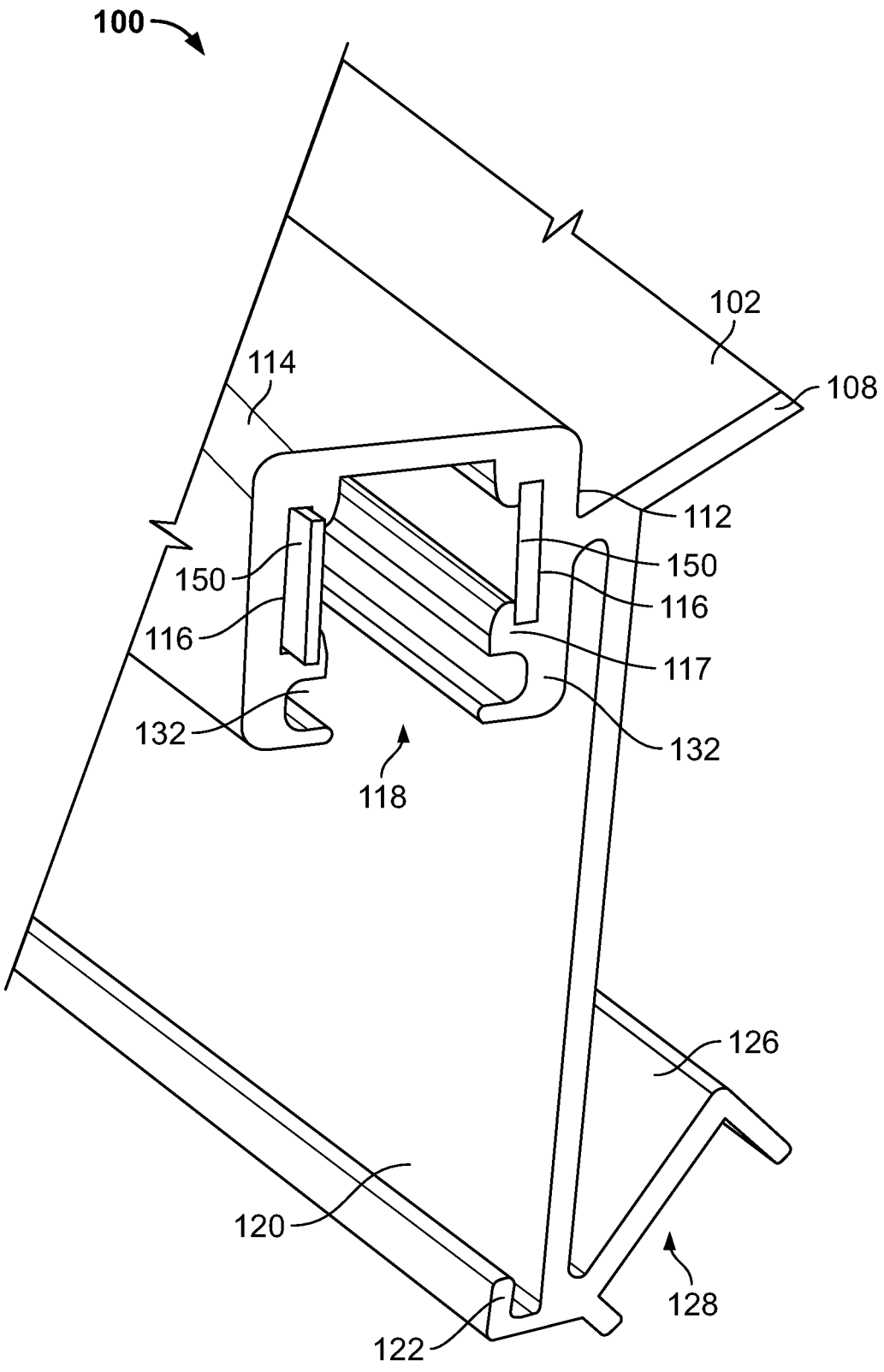
FIG. 9 depicts a partial isometric view of an alternate embodiment of the exemplary low voltage power system of FIG. 1 as disclosed herein.
Figure 10:
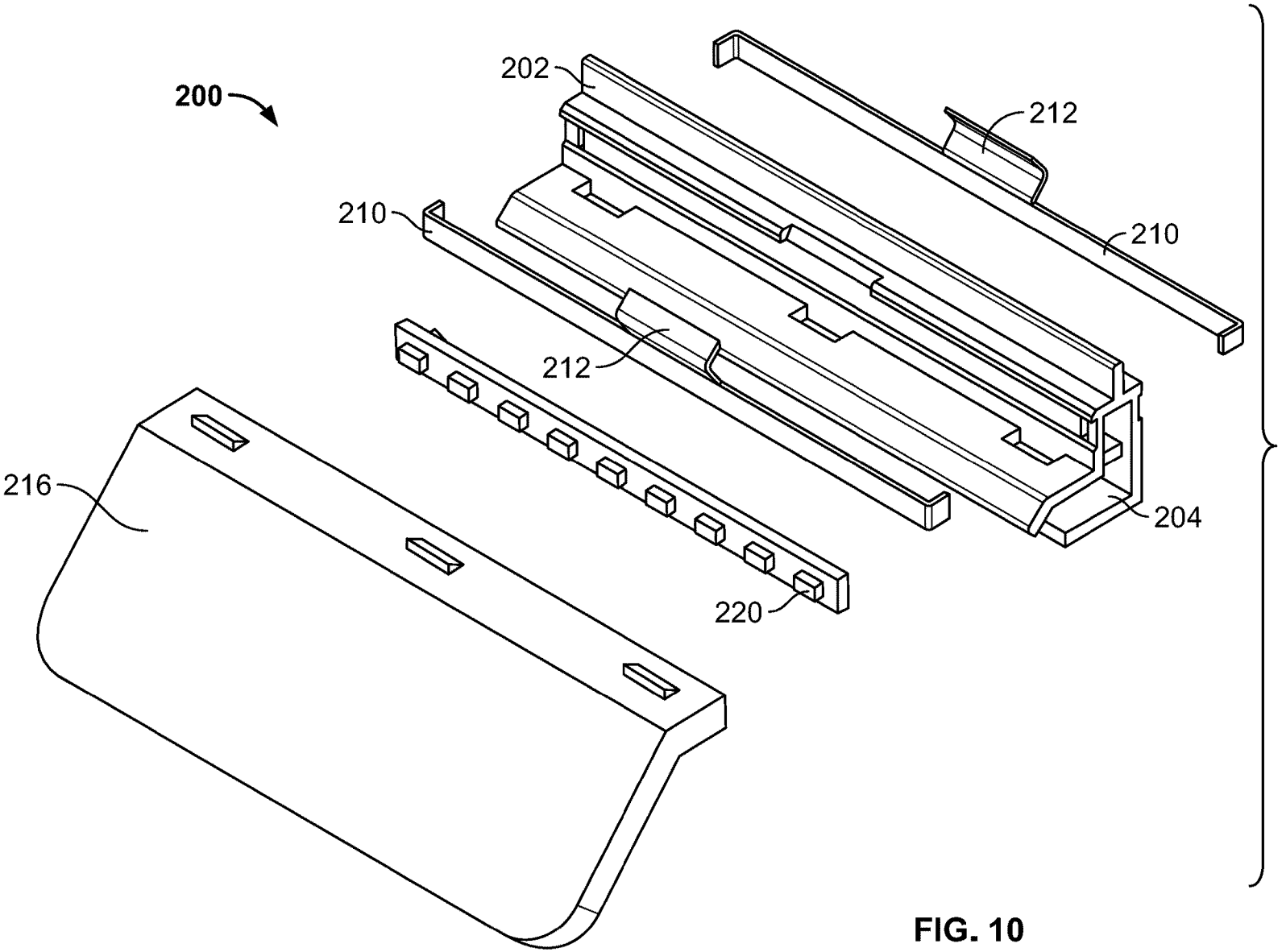
FIG. 10 depicts an exploded isometric view of an illuminated tab to engage the low voltage power system of FIG. 1 as disclosed herein.
Figure 11A:
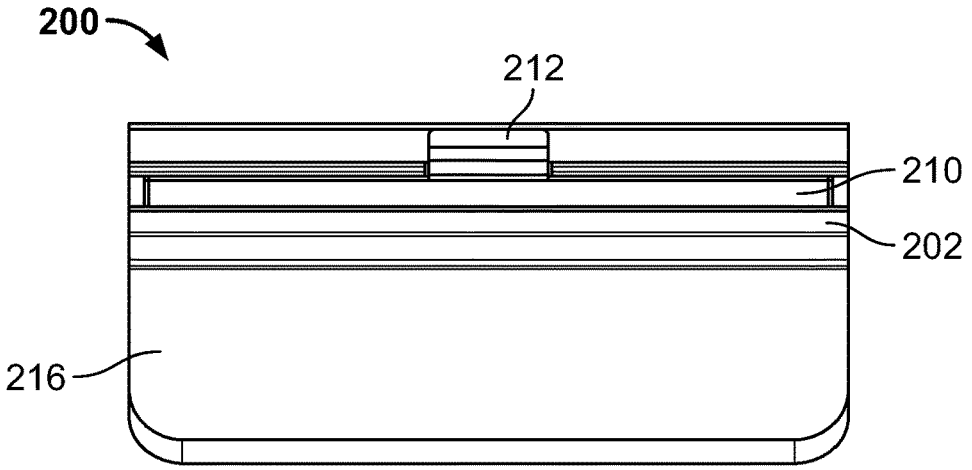
FIG. 11A depicts a front view of an illuminated tab to engage the low voltage power system of FIG. 1 as disclosed herein.
Figure 11B:
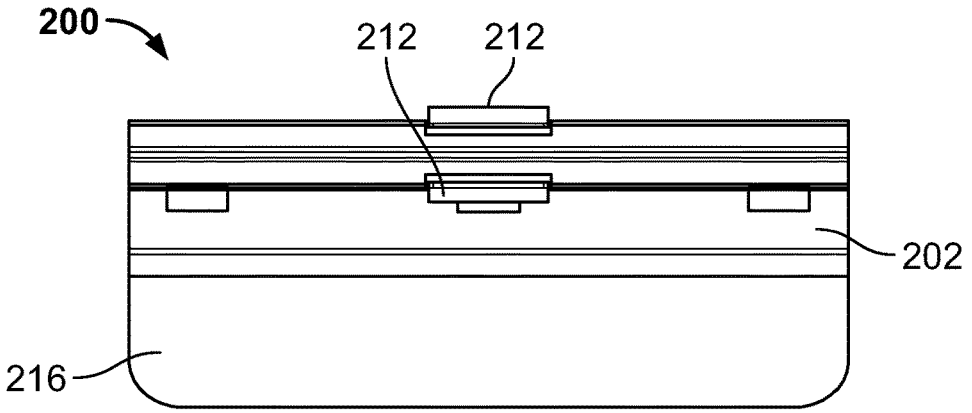
FIG. 11B depicts a top view of an illuminated tab to engage the low voltage power system of FIG. 1 as disclosed herein.
Figure 11C:
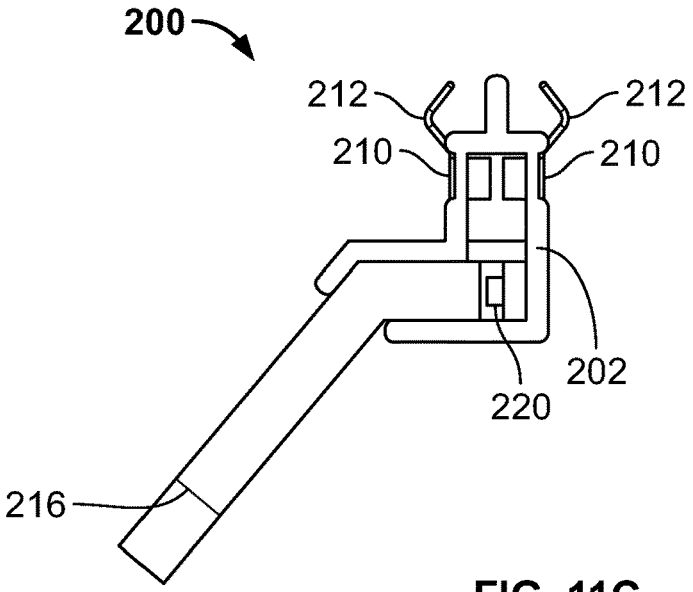
FIG. 11C depicts a right side view of an illuminated tab to engage the low voltage power system of FIG. 1 as disclosed herein.
Figure 12:
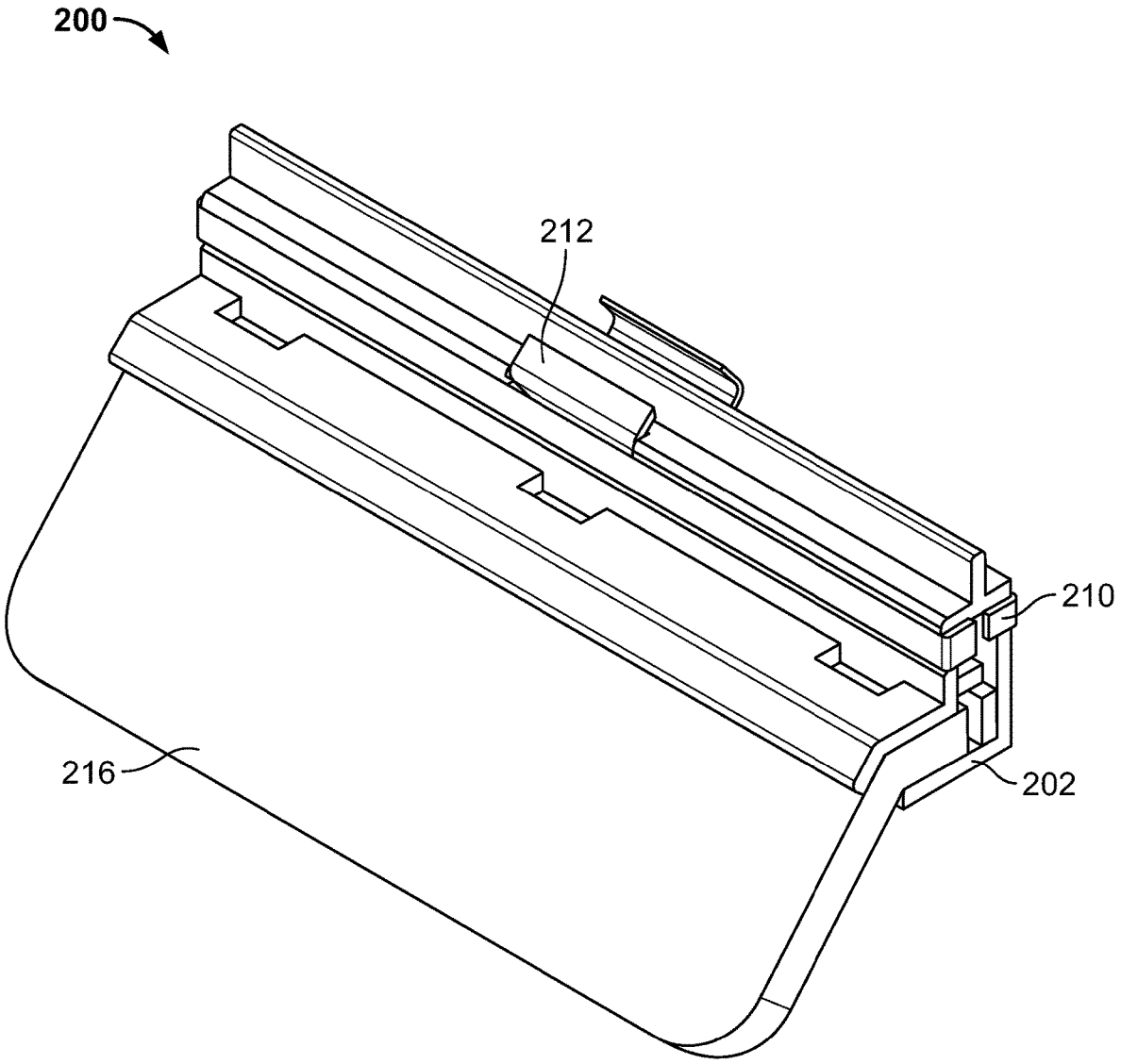
FIG. 12 depicts an isometric view of an illuminated tab to engage the low voltage power system of FIG. 1 as disclosed herein.
Figure 13:
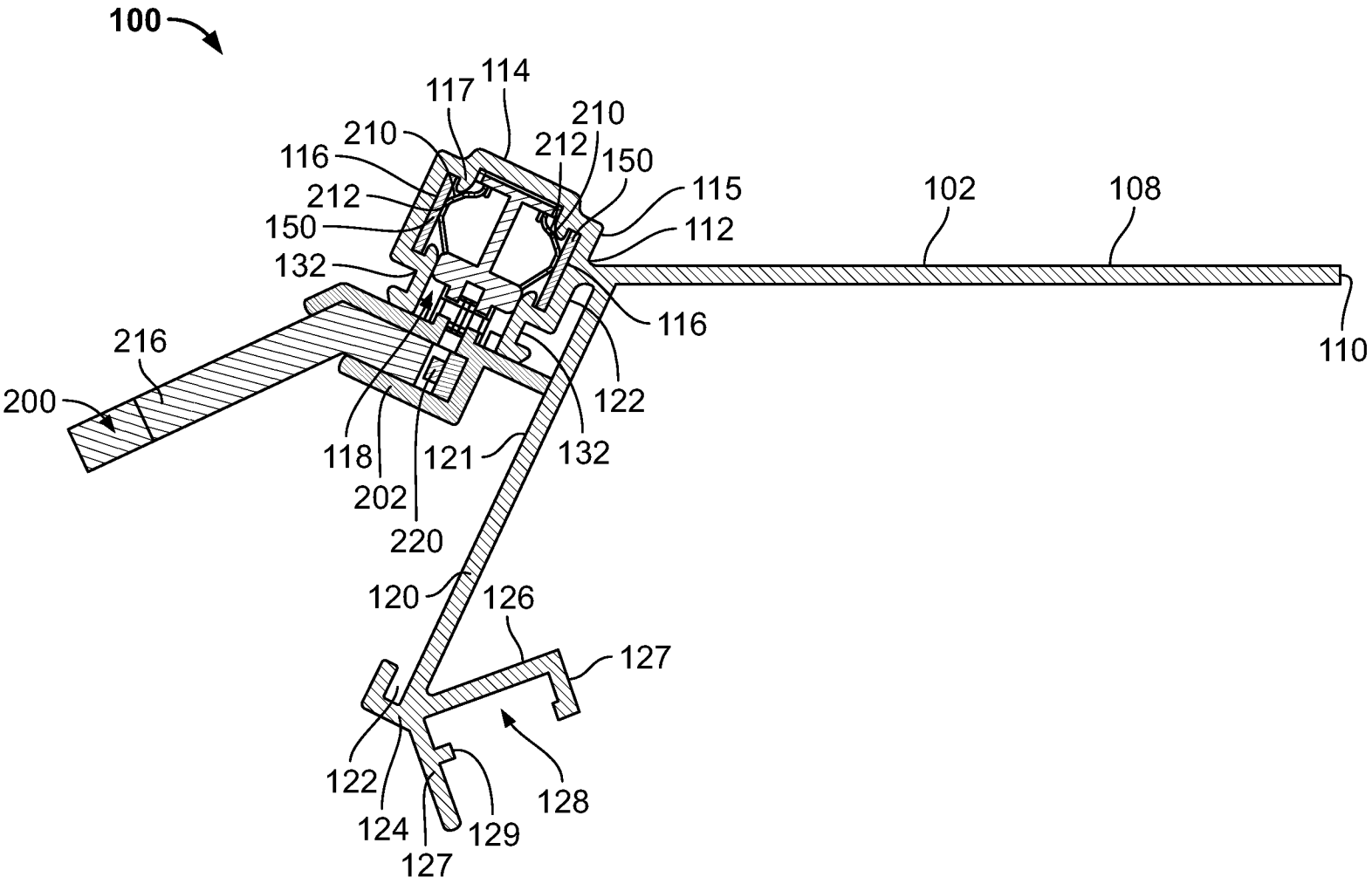
FIG. 13 depicts a side cross-sectional view of the low voltage power system of FIG. 1 with an illuminated tab engaged as disclosed herein.
Figure 14:
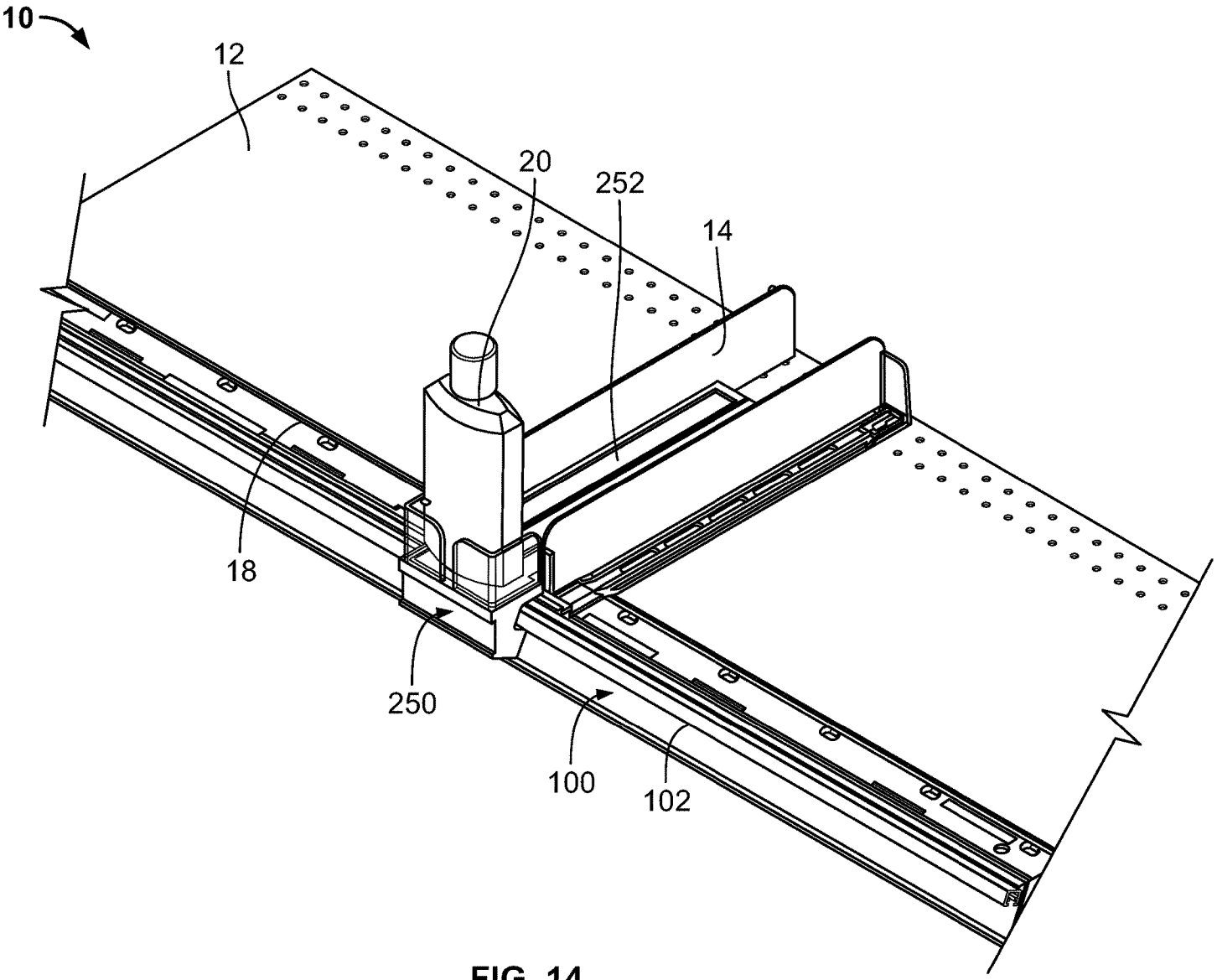
FIG. 14 depicts a partial isometric view of a merchandise display with the low voltage power system of FIG. 1 with an illuminated product highlighter engaged as disclosed herein.
Figure 15:
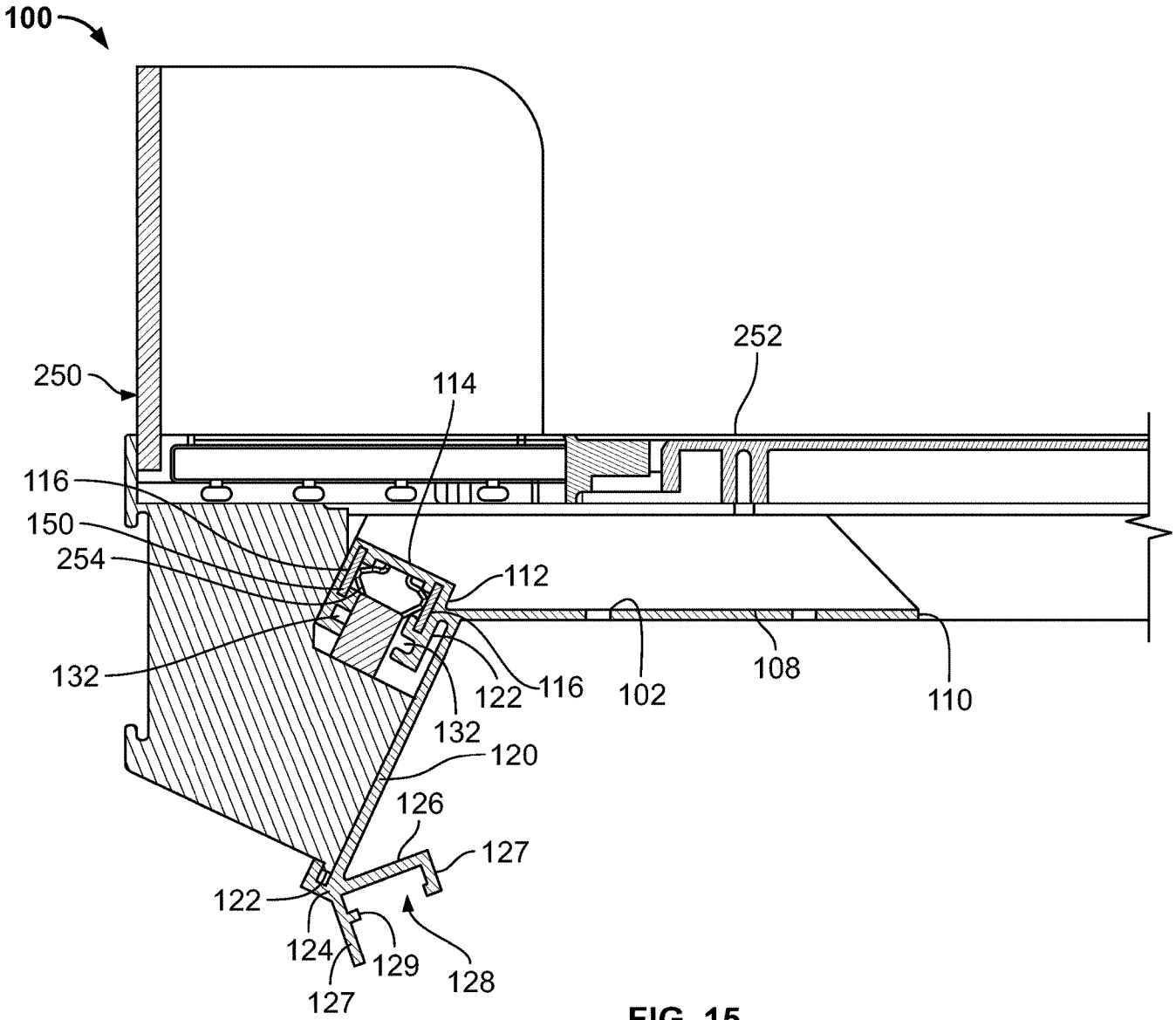
FIG. 15 depicts a side cross-sectional view of the low voltage power system of FIG. 1 with an illuminated product highlighter engaged as disclosed herein.
Figure 16:
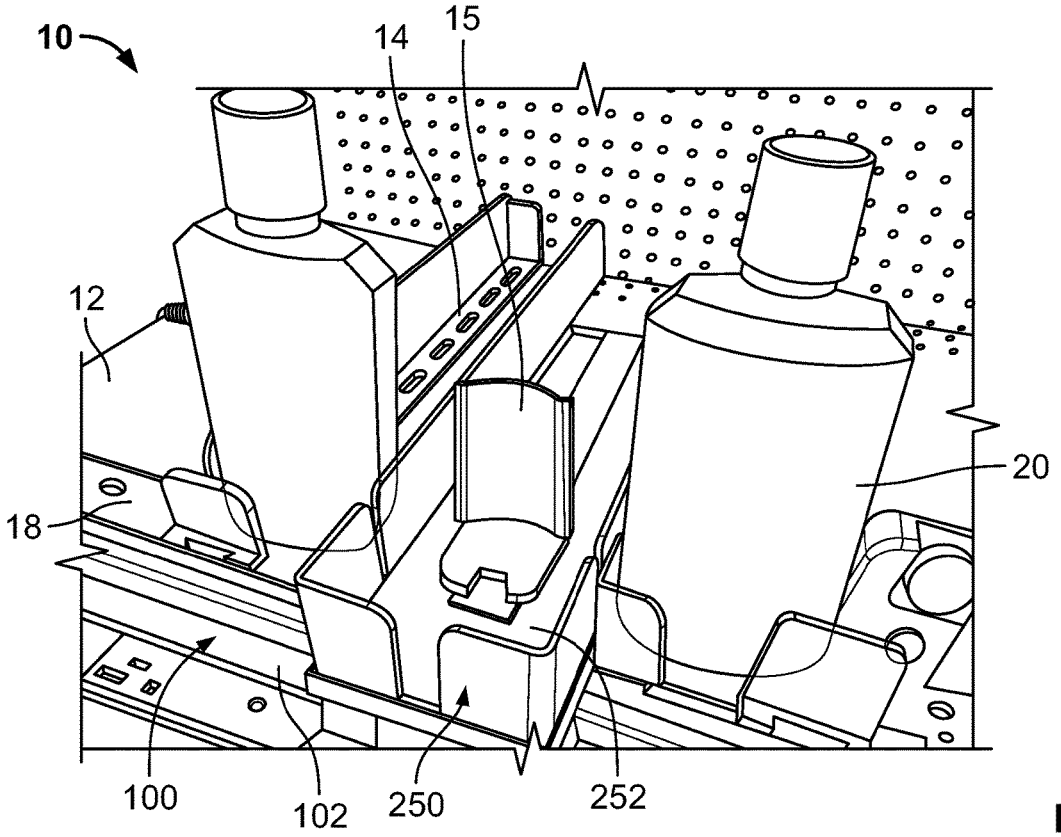
FIG. 16 depicts a partial isometric view of a merchandise display with the low voltage power system of FIG. 1 with an illuminated product highlighter as disclosed herein.
Figure 17:
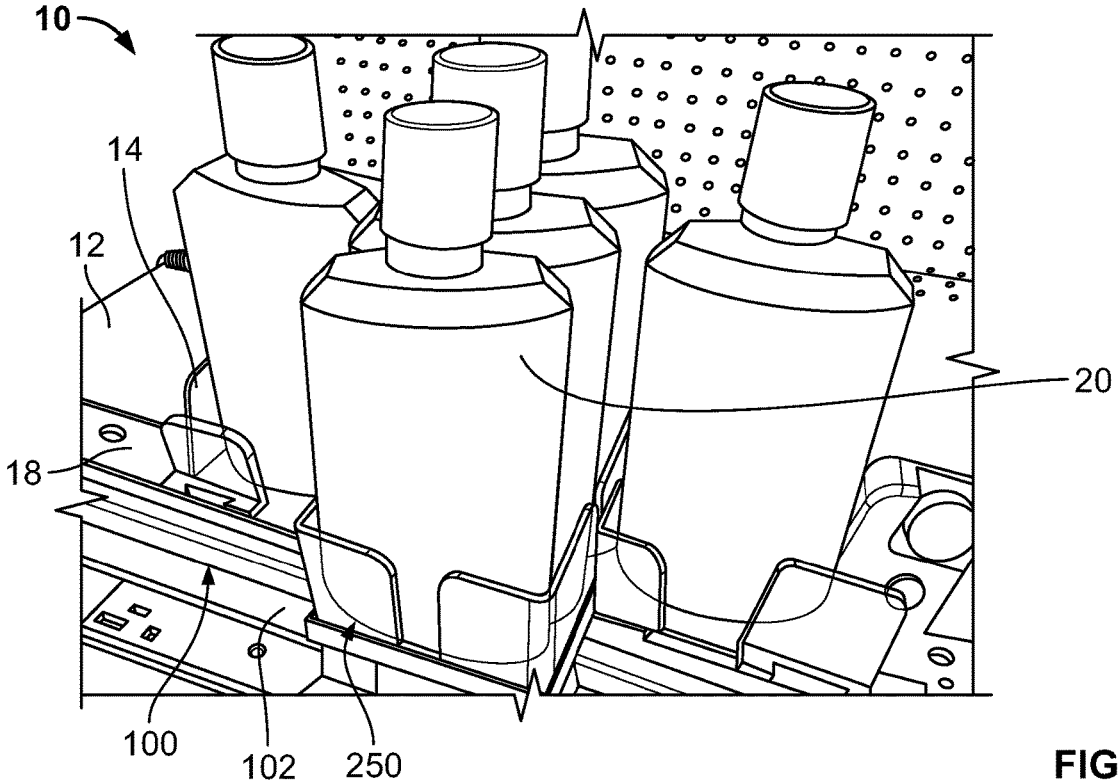
FIG. 17 depicts a partial isometric view of a merchandise display with the low voltage power system of FIG. 1 with an illuminated product highlighter as disclosed herein.

The power connector portion 114 may also include a pair of engaging members 132 that are positioned below the upper channels 116 that may help to secure a low voltage power device to the rail member 102. The engaging members 132 may be an outward facing channel as shown in FIG. 8 or alternatively an inward facing channel as shown in FIG. 9. The engaging members 132 may have a lower surface 133 to assist attaching the low voltage power devices to the rail member 102.

The conductive members 150 may be any material, shape, form, or type of conductive material, such as copper or brass that allow the distribution of power as known to those skilled in the art. The conductive members 150 may also be conductive wires, rods, or plates or other surfaces and materials that allow the distribution of power. As described above, each conductive members 150 may be continuous with each made of a single piece of material. Alternatively, the conductive members may be a plurality of pieces that may be intermittently placed within the upper channel 116.

The rail member 102 may be formed of a single unitary piece and formed of a polymer or other non-conductive material. The rail member 102 may be formed by a variety of techniques such as a thin walled extrusion process, or alternatively a molding process. Supplemental machining or other finishing processes may be performed on the rail member 102.

As described above, the low voltage power system 100 may transmit power to a variety of low power devices. FIGS. 10-13 illustrate an exemplary low power device in the form of an illuminated tab 200. The illuminated tab 200 comprises a tab clip 202 that may form the base of the illuminated tab 200, a pair of conductive contacts 210 may wrap around each side of the tab clip 202 with each conductive contact 210 including a spring contact 212 extending upward from a top surface of the conductive contact 210. Each of the spring contacts 212 engages a corresponding conductive member 150 of the low voltage power system 100. The conductive contacts 210 may extend a majority of length of the illuminated tab 200, while the spring contacts 212 may extend only a portion of the length of the illuminated tab 200. For example, the spring contacts 212 may have a length between 10 percent and 35 percent of the length of the illuminated tab 200, while in other embodiments, the spring contacts 212 may have a length between 15 percent and 25 percent of the length of the illuminated tab 200. The spring contacts 212 may provide both the electrical connection to the conductive members 150 as well as the mechanical connection necessary to secure the illuminated tab 200 to the rail member 102, such as a friction fit. Alternatively, the spring contacts 212 may only provide the electrical connection to the conductive members 150. The illuminated tab 200 may include an array of multiple LEDs 220 or other light sources that is secured in the lower opening 204 of the tab clip 202 and a label holder 216 that is connected to the tab clip 202. The LEDs when illuminated may help to attract attention to the product and also display any relevant information about the product to a consumer.

FIGS. 14-17 illustrate an illuminated product highlighter 250 powered by the low voltage power system 100. The product highlighter 250 may have electrical contacts 254 similar to the illuminated tab 200 such that the contacts engage the conductive members 150 of the low voltage power system 100. The product highlighter 250 may comprise a platform 252 to support the product 20 that extends out beyond the forward perimeter of the rail member 102 and extends rearward beyond the rear end 110 of the shelf-engaging member 108. The platform 252 may have a plurality of LEDs or other light sources that illuminates the platform 252 underneath the product 20. For example, the platform 252 may extend the entire length of the row of products from the front of the shelf 12 to the rear of the shelf 12. The platform 252 may include a transparent or translucent surface.

Figure 18:
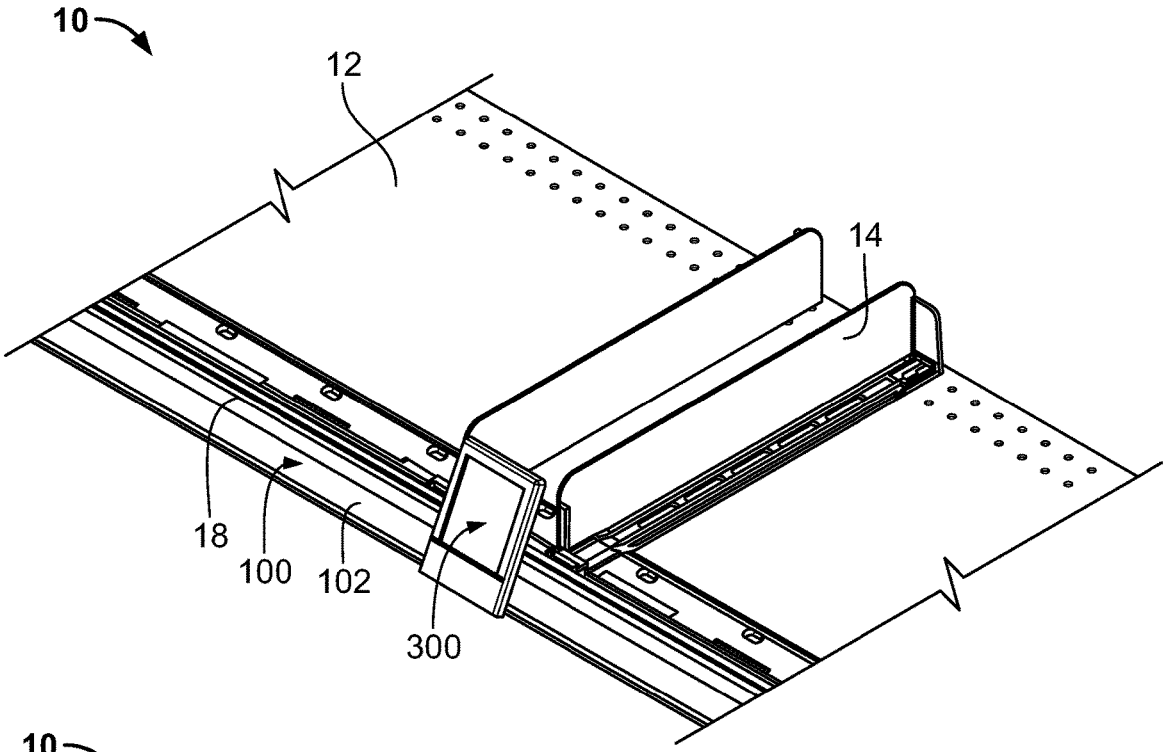
FIG. 18 depicts a partial isometric view of a merchandise display with the low voltage power system of FIG. 1 with an electronic product label as disclosed herein.
Figure 19:
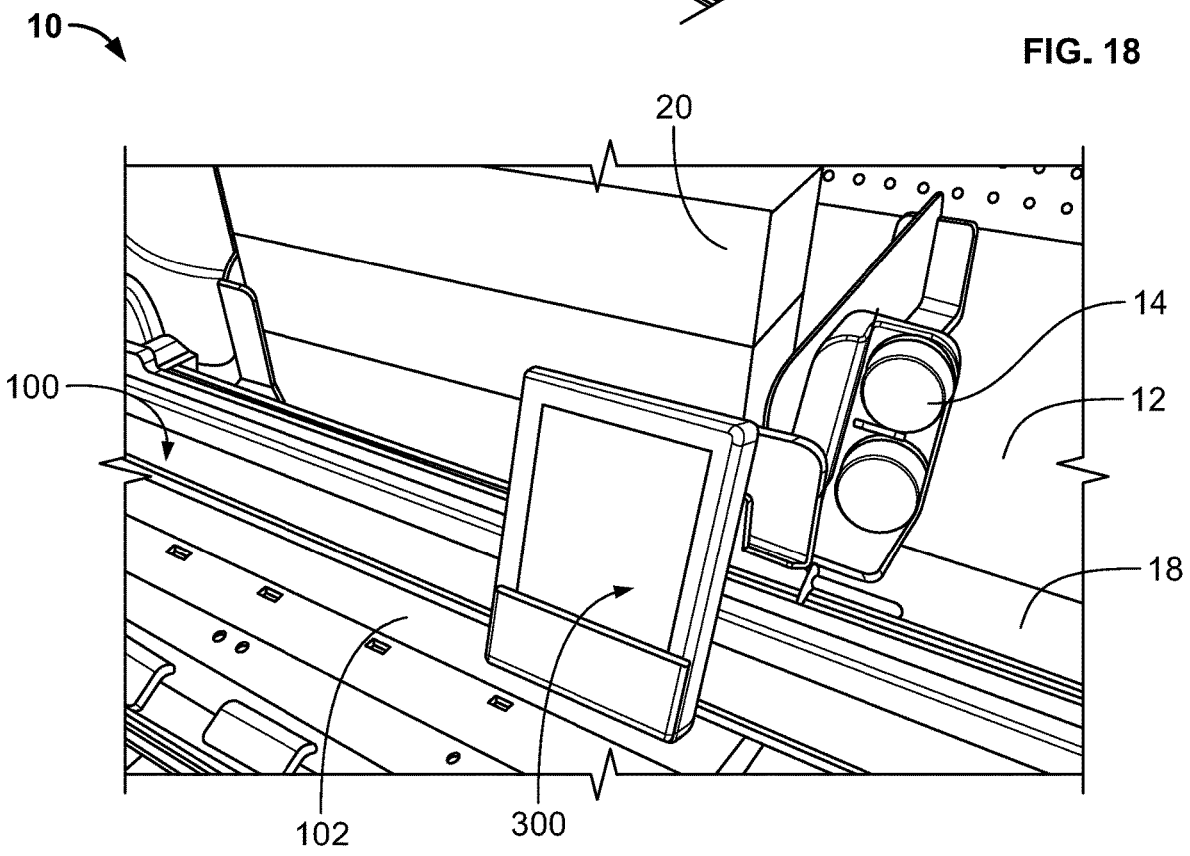
FIG. 19 depicts a partial isometric view of a merchandise display with the low voltage power system of FIG. 1 with an electronic product label as disclosed herein.
Figure 20:
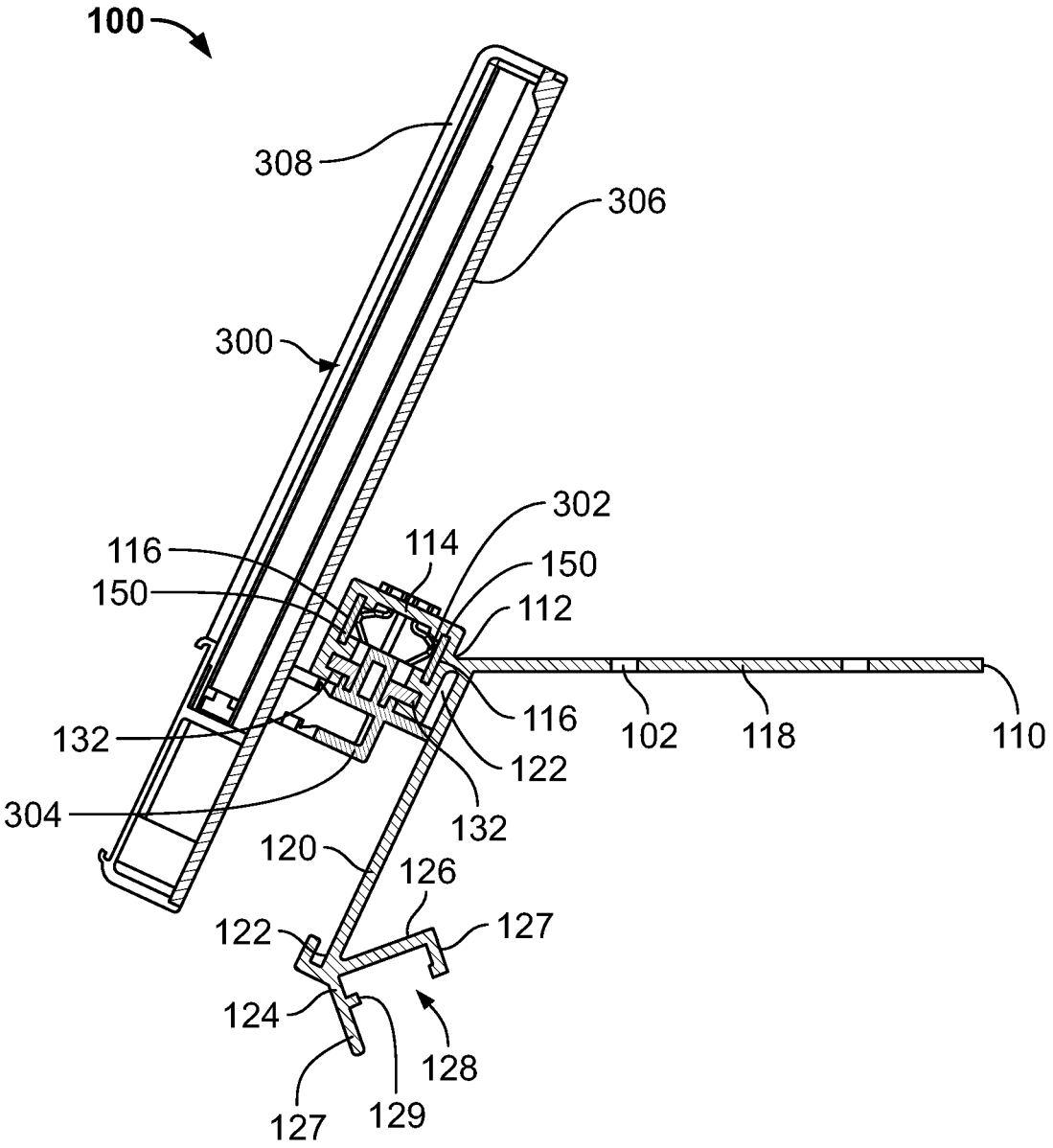
FIG. 20 depicts a side cross-sectional view of the low voltage power system of FIG. 1 with an electronic product label as disclosed herein.

As another example of a low voltage device that engages the low voltage power system 100 may be an electronic product label 300 as shown in FIGS. 18-20. The electronic product label 300 may have electrical contacts 302 similar to the illuminated tab 200 such that the contacts engage the conductive members 150 of the low voltage power system 100. The electronic product label 300 may also have a mounting structure 304 that extends below the electrical contacts 302 and extends forward to a support surface 306 that secures the electronic label 308. The support surface 306 may be substantially parallel to the front surface 121 of the label display holder 120 when the electronic product label 300 is engaged with the rail member 102.

The reader should understand that these specific examples are set forth merely to illustrate examples of the invention, and they should not be construed as limiting the invention. Many variations in the lighting assemblies may be made from the specific structures described above without departing from this invention. Those skilled in the art will appreciate that there are numerous variations and permutations of the above described systems and methods. Thus, the spirit and scope of the invention should be construed broadly as set forth in the appended claims.

What is claimed is:

1. A low voltage power system for a merchandise display comprising:

a rail member including:

a shelf-engaging member extending between a first end of the rail member and a second end of the rail member opposite the first end, wherein the shelf-engaging member is configured to contact an upper surface of a first shelf of the merchandise display, wherein the shelf-engaging member comprises a front end configured to be adjacent a front side of the first shelf of the merchandise display, a power connector portion attached to the front end of the shelf-engaging member and extending from the first end to the second end of the rail member, wherein the power connector portion includes a top surface, a front surface, a rear surface opposite the front surface, and a recess opposite the top surface, wherein the recess includes a pair of upper channels comprising a first upper channel on a first inner recess surface opposite the front surface and a second upper channel on a second inner recess surface opposite the rear surface, a first conductive member secured in the first upper channel and a second conductive member secured in the second upper channel, wherein the first and second conductive members transmit electrical power to at least one low voltage device;

a label display holder, wherein the label display holder extends below the shelf-engaging member and includes a central channel configured to secure a product label, and a receiving member that extends rearward from a lower edge of the label display holder, wherein the receiving member is configured to receive an LED lighting assembly to illuminate a second shelf below the first shelf.

2. The low voltage power system of claim 1, wherein the first conductive member and the second conductive member are continuous along approximately an entire length of the rail member, wherein the entire length is defined as a distance from the first end of the rail member to the second end of the rail member.

3. The low voltage power system of claim 1, wherein an end cap is secured within the recess in the first end or the second end of the rail member.

4. The low voltage power system of claim 1, wherein the low voltage power system has a voltage of less than 24 volts.

5. The low voltage power system of claim 1, wherein the at least one low voltage device includes a plurality of low voltage power devices.

6. The low voltage power system of claim 1, wherein the at least one low voltage device is powered at any location along a length of the rail member.

7. The low voltage power system of claim 1, wherein the shelf-engaging member includes a pair of elongated slots extending through the shelf-engaging member, wherein each slot of the pair of elongated slots receive an engaging member from a product management system, wherein the product management system includes a pusher system.

8. The low voltage power system of claim 7, wherein the shelf-engaging member is positioned underneath a front rail of the product management system.

9. The low voltage power system of claim 1, wherein the first conductive member and the second conductive member both have rectangular cross-sectional shapes.

10. A low voltage power system for a merchandise display comprising:

a rail member including:

a shelf-engaging member extending between a first end of the rail member and a second end of the rail member opposite the first end, wherein the shelf-engaging member is configured to contact an upper surface of a first shelf of the merchandise display, wherein the shelf-engaging member comprises a front end configured to be adjacent a front side of the first shelf of the merchandise display, a power connector portion attached to the front end of the shelf-engaging member and extending from the first end to the second end of the rail member, wherein the power connector portion includes a top surface, a front surface, a rear surface opposite the front surface, and a recess opposite the top surface, wherein the recess includes a pair of upper channels comprising a first upper channel on a first inner recess surface opposite the front surface and a second upper channel on a second inner recess surface opposite the rear surface, a first conductive member secured in the first upper channel and a second conductive member secured in the second upper channel, wherein the first and second conductive members transmit electrical power to at least one low voltage device, and, wherein the at least one low voltage device is an illuminated tab, wherein the illuminated tab includes a label holder, an array of LEDs secured in a tab clip, and a first conductive spring contact engaged with the first conductive member and a second conductive spring contact engaged with the second conductive member.

11. A low voltage power system for a merchandise display comprising:

a rail member including:

a shelf-engaging member extending between a first end of the rail member and a second end of the rail member opposite the first end, wherein the shelf-engaging member is configured to contact an upper surface of a first shelf of the merchandise display, wherein the shelf-engaging member comprises a front end configured to be adjacent a front side of the first shelf of the merchandise display, a power connector portion attached to the front end of the shelf-engaging member and extending from the first end to the second end of the rail member, wherein the power connector portion includes a top surface, a front surface, a rear surface opposite the front surface, and a recess opposite the top surface, wherein the recess includes a pair of upper channels comprising a first upper channel on a first inner recess surface opposite the front surface and a second upper channel on a second inner recess surface opposite the rear surface, a first conductive member secured in the first upper channel and a second conductive member secured in the second upper channel, wherein the first and second conductive members transmit electrical power to at least one low voltage device, wherein the first conductive member and the second conductive member are continuous along approximately an entire length of the rail member, wherein the entire length is defined as a distance from the first end to the second end, wherein the low voltage power system has a voltage of less than 24 volts, and wherein the at least one low voltage device is an illuminated product highlighter, wherein the illuminated product highlighter includes a platform for supporting product, a first electrical contact engaged with the first conductive member, a second electrical contact engaged with the second conductive member, and a plurality of LEDs that illuminate underneath the product.

12. The low voltage power system of claim 11, wherein the rail member includes a label display holder, wherein the label display holder extends below the shelf-engaging member and includes a central channel configured to secure a product label.

13. The low voltage power system of claim 12, wherein a receiving member extends rearward from a lower edge of the label display holder, wherein the receiving member is configured to receive an LED lighting assembly to illuminate a second shelf below the first shelf.

14. A low voltage power system for a merchandise display comprising:

a rail member including:

a shelf-engaging member extending between a first end of the rail member and a second end of the rail member opposite the first end, wherein the shelf-engaging member is configured to contact an upper surface of a first shelf of the merchandise display, wherein the shelf-engaging member comprises a front end configured to be adjacent a front side of the first shelf of the merchandise display, a power connector portion attached to the front end of the shelf-engaging member and extending from the first end to the second end of the rail member, wherein the power connector portion includes a top surface, a front surface, a rear surface opposite the front surface, and a recess opposite the top surface, wherein the recess includes a pair of upper channels comprising a first upper channel on a first inner recess surface opposite the front surface and a second upper channel on a second inner recess surface opposite the rear surface, a first conductive member secured in the first upper channel and a second conductive member secured in the second upper channel, wherein the first and second conductive members transmit electrical power to at least one low voltage device, and wherein the at least one low voltage device includes a first spring contact engaging the first conductor member and a second spring contact engaging the second conductor member, wherein the first spring contact and the second spring contact provide both an electrical connection to power the low voltage device and a mechanical connection to secure the low voltage device to the power connector portion.

15. The low voltage power system of claim 14, wherein the first conductive member and the second conductive member both comprise a plurality of pieces that are intermittently located within the power connector portion.

16. The low voltage power system of claim 14, wherein the first conductive member and the second conductive member are continuous along approximately an entire length of the rail member, wherein the entire length is defined as a distance from the first end to the second end.

17. The low voltage power system of claim 14, wherein the rail member includes a label display holder, wherein the label display holder extends below the shelf-engaging member and includes a central channel configured to secure a product label.

* * * * *